US011024133B2

(12) United States Patent
Davis et al.

(10) Patent No.: US 11,024,133 B2
(45) **Date of Patent: *Jun. 1, 2021**

(54) METHOD AND SYSTEM FOR A STACKED SYMBOL GAME AND A BONUS GAME

(71) Applicant: Epic Tech, LLC, Suwanee, GA (US)

(72) Inventors: Steven Wesley Davis, Suwanee, GA (US); Parag Rameshbhai Patel, Cumming, GA (US); Donald James Rollo, Dacula, GA (US)

(73) Assignee: Epic Tech, LLC, Suwanee, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/747,082

(22) Filed: Jan. 20, 2020

(65) Prior Publication Data

US 2020/0160669 A1 May 21, 2020

Related U.S. Application Data

(63) Continuation of application No. 15/944,215, filed on Apr. 3, 2018, now Pat. No. 10,733,850.

(60) Provisional application No. 62/565,701, filed on Sep. 29, 2017, provisional application No. 62/480,613, filed on Apr. 3, 2017.

(51) Int. Cl.
*G07F 17/34* (2006.01)
*G07F 17/32* (2006.01)

(52) U.S. Cl.
CPC ..... *G07F 17/34* (2013.01); *G07F 17/3258* (2013.01); *G07F 17/3267* (2013.01)

(58) Field of Classification Search
CPC ..... G07F 17/3276; G07F 17/3272; G07F 17/3262; G07F 17/3265
See application file for complete search history.

(56) References Cited

U.S. PATENT DOCUMENTS

| | | | | |
|---|---|---|---|---|
| 6,997,804 | B2 | 2/2006 | Berman | |
| 9,251,656 | B2 * | 2/2016 | Cuddy | G07F 17/3258 |
| 9,846,985 | B2 | 12/2017 | Weatherby | |
| 9,886,815 | B2 * | 2/2018 | Adams | G07F 17/3213 |
| 10,614,668 | B2 | 4/2020 | Davis | |
| 10,636,243 | B1 | 4/2020 | Davis | |
| 2003/0013517 | A1 * | 1/2003 | Bennett | G07F 17/3267 463/25 |

(Continued)

*Primary Examiner* — Reginald A Renwick
(74) *Attorney, Agent, or Firm* — Baker Donelson; Carl M. Davis, II

(57) ABSTRACT

A gaming system including an input device, at least one display device configured to display a game comprising a matrix of rotating reels, a processor, and at least one memory including computer program code. The processor and memory are configured to cause the gaming system to receive a request from the input device to initiate a spin in a first game, cause, in response to the request, causing a plurality of reels to virtually spin. Each of the plurality of reels includes a plurality of first symbols and at least one bonus symbol. The memory and processor are also configured to cause the gaming system to determine, in response to a cessation of spinning of the plurality of reels, a number of bonus symbols displayed within a reel display matrix and trigger a second game in response to the number of bonus symbols satisfying a predetermined bonus symbol threshold.

22 Claims, 28 Drawing Sheets

(56) References Cited

U.S. PATENT DOCUMENTS

| | | | | |
|---|---|---|---|---|
| 2006/0073879 | A1* | 4/2006 | Baerlocher | G07F 17/3267 463/20 |
| 2008/0182650 | A1* | 7/2008 | Randall | G07F 17/32 463/25 |
| 2009/0137309 | A1 | 5/2009 | Thomas | |
| 2010/0298042 | A1* | 11/2010 | Berman | G07F 17/3244 463/20 |
| 2013/0023329 | A1 | 1/2013 | Saunders | |
| 2014/0087833 | A1 | 3/2014 | Berman | |
| 2015/0072751 | A1 | 3/2015 | Hallerbach | |
| 2018/0268659 | A1 | 9/2018 | Chesworth | |
| 2019/0197833 | A1 | 6/2019 | Mosley | |
| 2019/0333342 | A1 | 10/2019 | Caldwell | |

* cited by examiner

METHOD AND SYSTEM FOR A STACKED SYMBOL GAME AND A BONUS GAME

CROSS-REFERENCE TO RELATED APPLICATIONS

This application claims the benefit of U.S. Provisional Application No. 62/480,613 filed on Apr. 3, 2017, entitled "Method and System for a Stacked Symbol," and U.S. Provisional Application No. 62/565,701 filed on Sep. 29, 2017, entitled "Method and System for a Stacked Symbol Game and a Bonus Game," the contents of each of which are incorporated herein by reference in their entirety.

BACKGROUND

The present invention relates to gaming machines for the playing of games of skill or chance and, more particularly, to special features of games which may be offered on such machines. Standard gaming devices and games display (mechanically, electronically simulated, or otherwise) a number of reels marked with a number of symbols. In the standard game, the reels spin and stop randomly. If the pattern of symbols displayed on the stopped reels corresponds to a predetermined winning pattern, the device awards the player with a prize. In some games, a skill element is required in order to win the game, such as nudging one or more of the reels in a particular direction in order to create a winning pattern.

Machines and games that offer novel and stimulating variations on the basic reel-based games, yet comply with the strict regulatory restrictions set forth for the gaming industry, are eagerly sought after and there is intense competition between manufacturers to innovate. As such, vast amounts of time, energy, and financial resources are put into the development of new gaming concepts, such as those described and claimed herein.

SUMMARY OF THE INVENTION

The present invention meets the need in the art by providing invention is directed to a gaming system comprising at least one input device, at least one display device configured to display a game comprising a matrix of reels, and a processor with at least one memory including computer program code configured to, with the processor, cause the gaming system to: receive a spin request from the input device to initiate a first spin in a primary game; cause, in response to the request, a plurality of reels to virtually spin, wherein each of the plurality of reels comprises a plurality of first symbols and at least one of the reels comprises at least one bonus symbol; determine, in response to a cessation of spinning of the plurality of reels, a number of bonus symbols displayed within a reel display matrix; trigger a secondary game in response to the number of bonus symbols satisfying a predetermined bonus symbol threshold, wherein in the secondary game, at least one bonus symbol comprises a first indicia and a second indicia, wherein the first indicia indicates a first award and the second indicia indicates a second award, and wherein the first award is a different award type than an award type of the second award; and initiate, within said secondary game, at least one additional spin, wherein the at least one bonus symbol is locked in a designated symbol position during the additional spin.

In another aspect, the invention meets the need in the art by providing a gaming system comprising at least one input device, at least one display device configured to display a game comprising a matrix of rotating reels, and a processor with at least one memory including computer program code configured to, with the processor, to cause the gaming system to: receive a spin request from the input device to initiate a first spin in a primary game, cause, in response to the request, a plurality of reels to virtually spin, wherein each of the plurality of reels comprises a plurality of first symbols and at least one of the reels comprises at least one bonus symbol; determine, in response to a cessation of spinning of the plurality of reels, a number of bonus symbols displayed within a reel display matrix; trigger a secondary game in response to the number of bonus symbols satisfying a predetermined bonus symbol threshold, wherein in the secondary game, at least one bonus symbol comprises a first indicia and a second indicia, wherein the first indicia indicates a first award and the second indicia indicates a second award, and wherein the first award is a different award type than the second award; lock an indication of the bonus symbols from the first game at respective positions in the reel display matrix in the second game; sequentially display the first award and the second award, each associated with a bonus symbol; initiate an additional spin in the second game, wherein each of the plurality of reels comprises at least one additional bonus symbol; decrement an available number of remaining spins in the second game; lock an indication of an additional bonus symbol, in response to a cessation of the additional spin of the plurality of reels in the second game, at a respective position in the reel display matrix; sequentially display a point value and a number of spins awarded, each associated with an additional bonus symbol; and repeat the initiate, decrement, lock, and sequentially display steps until no remaining spins are available in the second game.

In another embodiment, the invention is directed to methods comprising the above (and herein) steps and non-transitory computer readable medium recording a program for controlling a computer to function as is set forth above and herein.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

DESCRIPTION OF SOME EMBODIMENTS

Reference will now be made in detail to embodiments of the present systems and methods, one or more examples of which are illustrated in the accompanying drawings. Each example is provided by way of explanation, not limitation of the present system. In fact, it will be apparent to those skilled in the art that modifications and variations can be made to the present system and methods without departing from the scope or spirit thereof. For instance, features illustrated or described as part of one embodiment may be used in another embodiment to yield a still further embodiment. Thus, the present system and methods cover such modifications and variations as come within the scope of the appended claims and their equivalents.

Stacked Symbol Game

Figure 3:
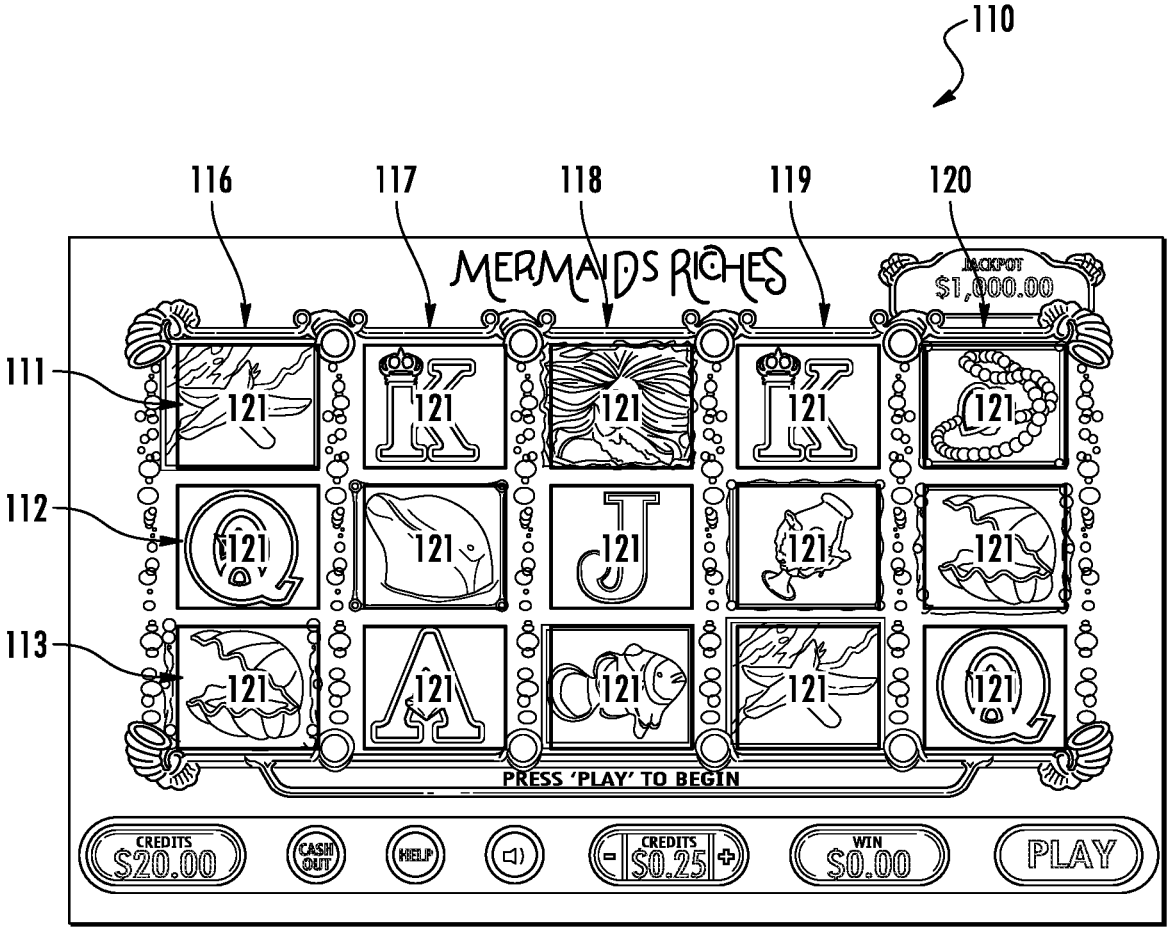
FIG. 3 is an embodiment of the game display of the present invention.
Figure 4:
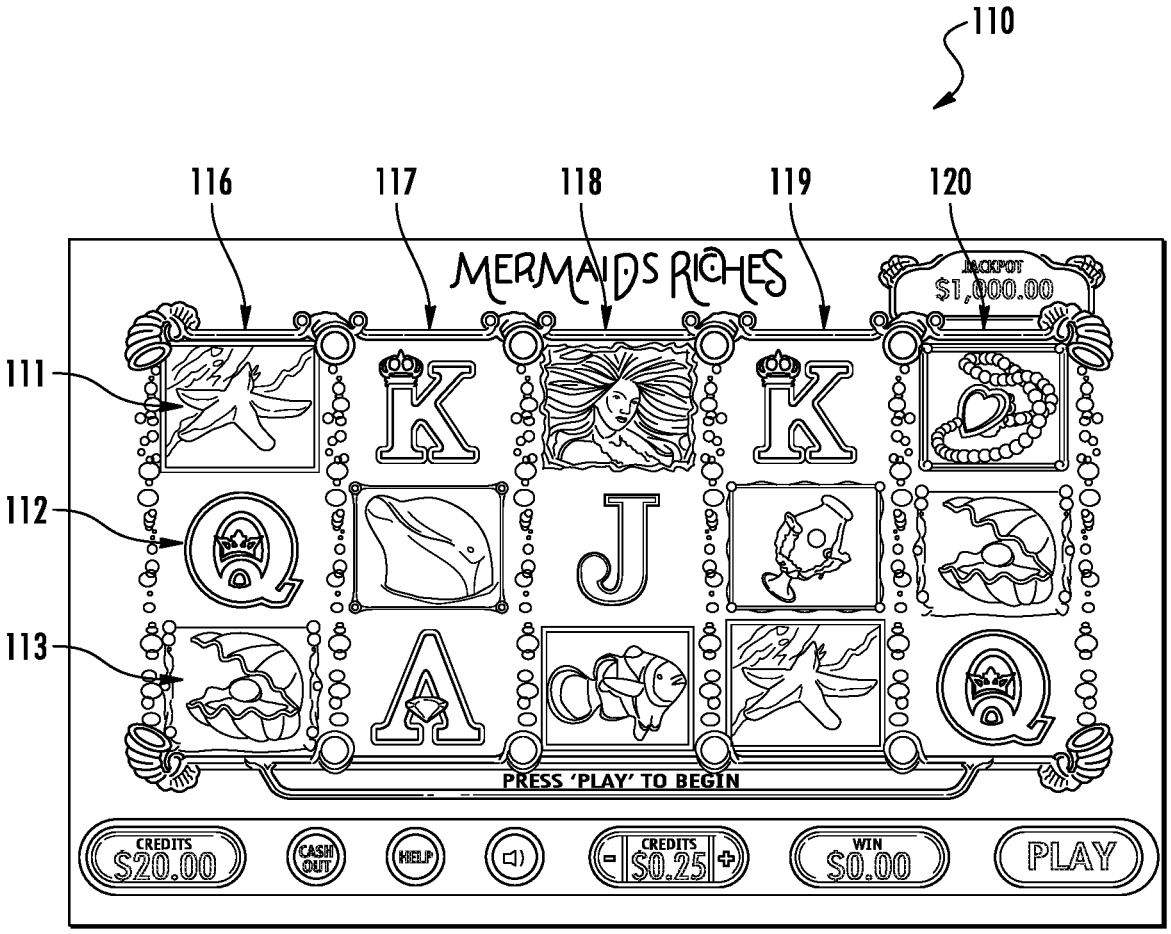
FIG. 4 is an embodiment of the game display of the present invention.

The present invention is directed generally to a novel and exciting gaming machine, system, and methodology. In an embodiment, shown in FIGS. 1-4, the invention is directed to a game based upon one or more simulated rotatable reels, displayed in a matrix format 110 of columns 116, 117, 118, 119, and 120 and rows 111, 112, 113, 114, and 115. In an embodiment, each reel is displayed as a vertical matrix column 116, 117, 118, 119, and 120 and contains one or more symbol positions 121 within each column. Any number of reels (columns) may be utilized in the present invention. In some embodiments, three, four, or five reels may be displayed. Similarly, any number of rows 111, 112, 113, 114, and 115 may be displayed. In an embodiment, the number of rows displayed at any given time may be three, four, or five rows, but the invention should not be so limited. Regardless of the number of matrix rows displayed to a participant, such as the three rows 111, 112, and 113, set forth in FIG. 3, the number of rows (and symbol positions 121) in any particular reel/column may be greater than the number of rows displayed. For example, a particular game may display five reels, each having three displayed rows of symbol positions, for a total of 15 displayed symbol positions (such as is set forth in FIG. 3). However, each of those five reels may actually comprise 20, 30, 50, 100, or any other number of rows or symbol positions 121 which are not displayed.

In an embodiment, each of the reels that is displayed in a column for a particular game is selected from a database of reel strips 100. The database may contain any number of reel strips 101, 102, 103, 104, and 105. In an embodiment, some reel strips may be related. For example, there may be a particular set of reel strips available for reel 1, a different set of reel strips available for reel 2, and yet a different set of reel strips available for reel 3. Alternatively, the reel strip for each reel may be selected from a common pool of reel strips.

Each pool or set of reel strips may contain any number of reel strips. In an embodiment, the processor selects reel strips from the database prior to each game to determine the reel strip that will displayed for each reel. This selection may be random or predetermined. In an embodiment, the system may first randomly select a reel strip for reel 1, then randomly select a reel strip for reel 2, and then randomly select a reel strip for reel 3 (or in any other order known). These selections may occur nearly simultaneously. Alternatively, the processor may select reel strips for all available reels simultaneously. Similarly, the reel strips may be displayed within the reel positions in any order known in the art or may be displayed simultaneously.

In an embodiment, the database may contain a set of reel strips that are associated with multiple reels. For example, set "ABC" of reel strips may contain a particular reel strip for reel 1, a particular reel strip for reel 2, and a particular reel strip for reel 3. In this embodiment, the processor may separately (randomly or predeterminedly) select each reel strip within the set or may selected set ABC itself and thereby display the particular reel strip associated with each reel within the set.

Each reel strip may contain any number of symbol positions 121, each configured to display a symbol. For example, each reel strip may contain 20, 30, 50, or 100 (or any other number) symbol positions 121. In an embodiment of the invention, each reel strip has a finite and/or predetermined number of symbol positions 121. In another embodiment, the number of symbol positions 121 in each reel strip is varies. In a particular embodiment, the number of symbol positions 121 in each reel strip is randomly determined for each game or for a set of games.

Figure 1:
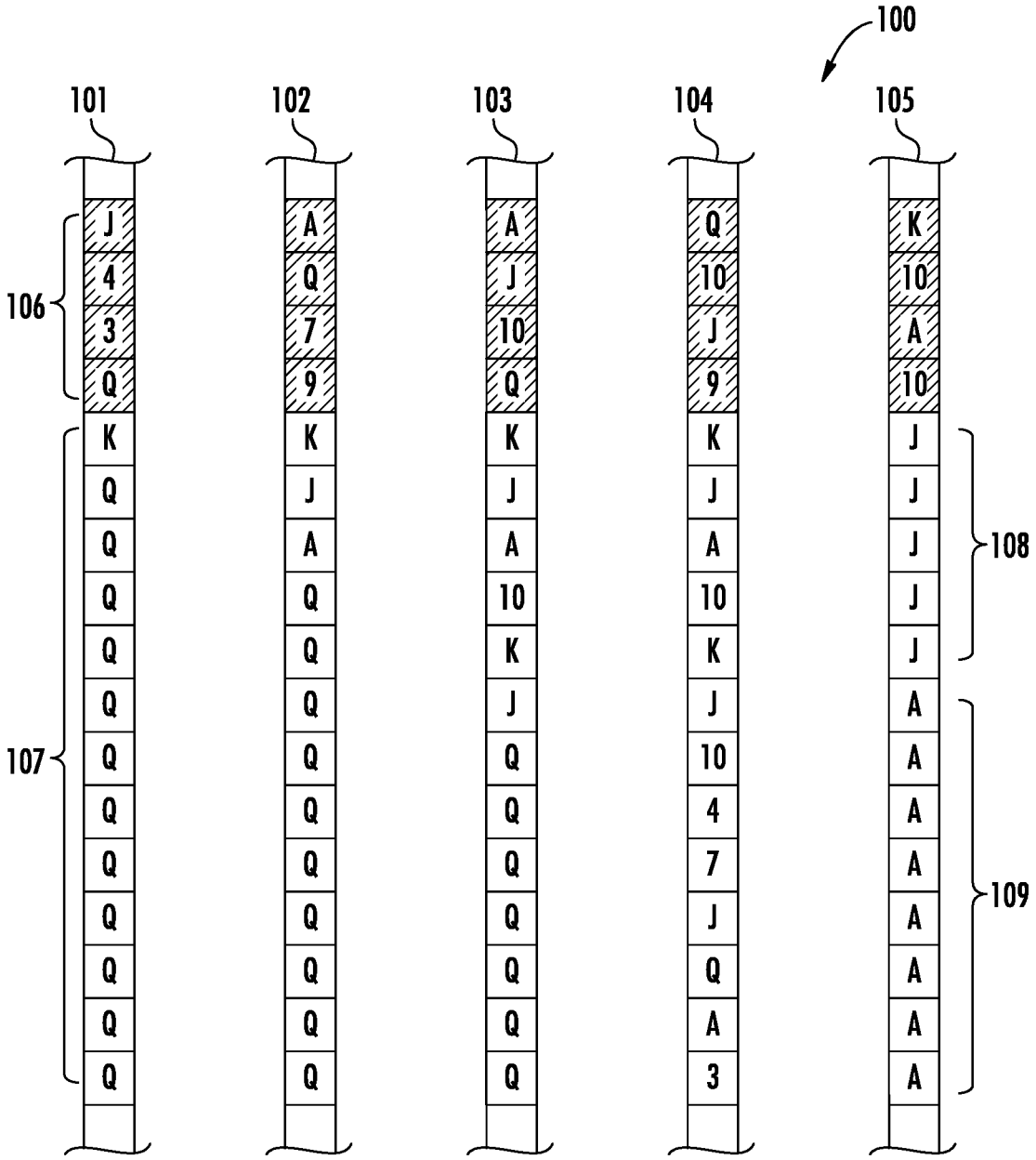
FIG. 1 is a schematic representation of reel strips in an embodiment of the present invention.
Figure 2:
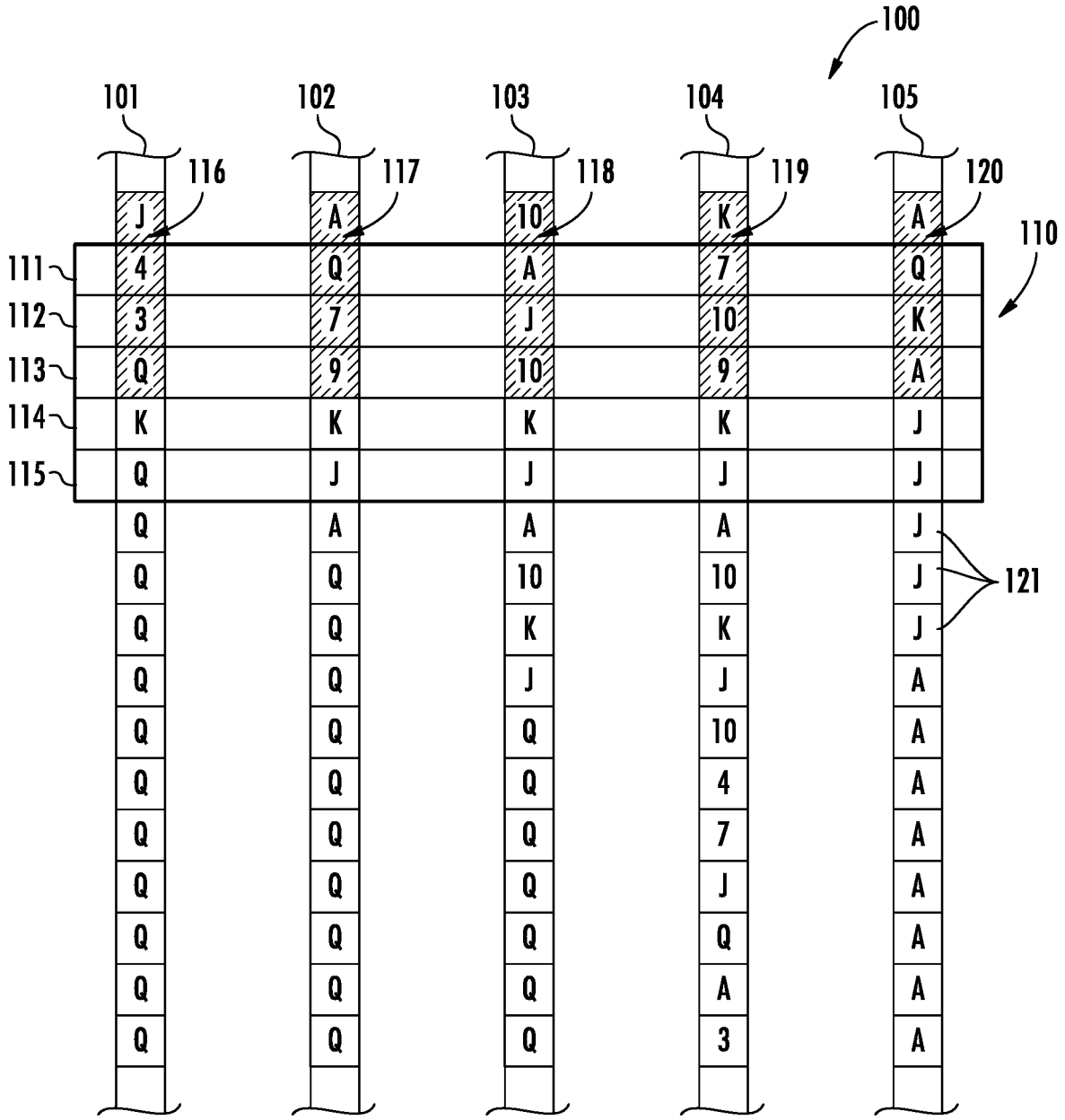
FIG. 2 is a schematic representation of reel strips in an embodiment of the present invention.

In a particular embodiment, shown in FIG. 1, at least one reel strip 101, 102, 103, 104, and 105 (but could include some, a majority or all of the reel strips) contains a predetermined number of first consecutive symbol positions 106 and a predetermined number of second consecutive symbol positions 107. In an embodiment, the number of first consecutive symbol positions 106 and the number of second consecutive symbol positions 107 are the same. In an embodiment, the number of first consecutive symbol positions 106 and the number of second consecutive symbol positions 107 are the different. In another embodiment, the number of first consecutive symbol positions 106 and the number of second consecutive symbol positions 107 are different from one another but remain constant for each reel strip and/or remain the same for each game played. For example, a first reel strip may have 20 first consecutive symbol positions and 30 second consecutive symbol positions (different from each other), but each and every reel strip may have this 20/30 setup.

In an embodiment, the number of first consecutive symbol positions 106 is the same for each reel strip and/or remain the same for each game played. In an embodiment, the number of second consecutive symbol positions 107 is the same for each reel strip and/or remain the same for each game played.

In an embodiment, the first consecutive symbol positions 106 may be randomly populated with symbols. In another embodiment, the first consecutive symbol positions 106 may be populated with predetermined symbols which are not identical to one another. In an embodiment, the first consecutive symbol positions 106 may be populated with symbols that are not necessarily identical to one another, but are predetermined and are the same for some or all of the reel strips. In such an embodiment, the symbols in the first consecutive symbol positions 106 may remain the same for each game played. In an embodiment, the symbols populating the first consecutive symbol positions 106 may be different for each reel strip. In another embodiment, the symbols populating the first consecutive symbol positions 106 may be different for at least two reel strips. In another embodiment, at least one symbol populating the same symbol position 121 within the first consecutive symbol positions 106 may be different for at least two reel strips. In yet another embodiment, at least one symbol populating the same symbol position 121 within the first consecutive symbol positions 106 may be different for at least two games played. In a further embodiment, at least one symbol populating the same symbol position 121 within the first consecutive symbol positions 106 may be different for the first two games played by any player.

In an embodiment, the second consecutive symbol positions 107 may be populated with consecutive identical symbols, e.g. "stacked symbols". Each reel strip may have a different identical symbol populated in its second consecutive symbol positions 107 or some reel strips may have the same identical symbol populated into their second consecutive symbol positions 107. The identical symbols may be predetermined or may be randomly selected to populate the second consecutive symbol positions 107. The second consecutive symbol positions 107 may be populated with identical symbols in every symbol position within the second consecutive symbol positions 107, in an embodiment. In an embodiment, at least one second consecutive symbol position 107 comprises a non-identical symbol. In other embodiments, some consecutive identical symbols, or no identical symbols may populate the second consecutive symbol positions 107. For example, in FIG. 1, reel strip 101 contains 13 second consecutive symbol positions 107 and 12 consecutive identical symbols ("Q") and reel strip 103 contains 13 second consecutive symbol positions 107 and 7 consecutive identical symbols ("Q"). Similarly, the second consecutive symbol positions 107 may be populated with one or more groups of different identical symbols. For example, in FIG. 1, reel strip 105 contains 13 second consecutive symbol positions 107 and two groups of consecutive identical symbols: 5 identical symbols ("J") and 8 other identical symbols ("A"). The groups of consecutive identical symbols need not be consecutive to each other and could, for example, be separated by one or more non-identical symbols within the reel strip.

The number of symbol positions in the first consecutive symbol positions 106 and the second consecutive symbol positions 107 may vary. For example, if a reel strip comprises 50 symbol positions, 20 of those symbol positions may comprise first consecutive symbol positions 106 and 30 of those symbol positions may comprise second consecutive symbol positions 107. Similarly, if a reel strip comprises 50 symbol positions, 30 of those symbol positions may comprise first consecutive symbol positions 106 and 20 of those symbol positions may comprise second consecutive symbol positions 107. Any other variation is encompassed herein.

In an embodiment, the processor consults a weighted table to determine the combination of reel strips (the "reel strip combination") that will be selected for a particular game. In this embodiment, there may be a finite number of reel strips and/or reel strip combinations, each having an associated weight. For example, if a game has 5 reels and 11 reel strips per reel (55 total reel strips), there may be 161,051 possible reel strip combinations. Each reel strip combination may be associated with a letter, number, or other indicia, or a set of letters, numbers, or other indicia. For example, a set of 5 numbers may be associated with each reel strip combination for a system having 5 reels.

In an embodiment, each reel strip combination has more than one associated weights. In this embodiment, one of the weights may be associated with a base game and one or more weights may be associated with a bonus game.

In an embodiment, the table may be indexed to indicate which reel strip should be selected for each reel. For example, the table may be indexed so that ⅜ indicates that reel strip 8 should be selected for reel 3. In an embodiment, each of the reel strips is unique. For example, reel strip 3 for reel 1 may be different from reel strip 3 for reel 2. With reference to Table 1, the table may be indexed as indicated. In this example, if the processor selects Index #2847 from Table 1, reel 1 will be populated with reel strip 3, reel 2 will be populated with reel strip 1, reel 3 will be populated with reel strip 4, reel 4 will be populated with reel strip 9, and reel 5 will be populated with reel strip 7. Index #2847 may be indicated as 1(reel)/3(associated reel strip), 2/1, 3/4, 4/9, 5/7.

TABLE 1

| Index # | Reel 1 | Reel 2 | Reel 3 | Reel 4 | Reel 5 |
|---|---|---|---|---|---|
| 0001 | 1 | 1 | 1 | 1 | 1 |
| 0002 | 2 | 1 | 1 | 1 | 1 |
| 2847 | 3 | 1 | 4 | 9 | 7 |
| 2848 | 3 | 1 | 4 | 9 | 8 |

In an embodiment, the table additionally comprises one or more subsets of indices. For example, the table could be configured such that if, in game one, Index #0001 is selected, only a subset of the 161,051 possible reel strip combinations would be available in game 2. Similarly, once the Index # is determined for game 2, only a subset of the possible combinations that were available in the second game would be available in game 3. This process may repeat for a defined period of time, defined number of games, or until a defined number of combinations is available, before resetting and making all available combinations available once again.

In another embodiment, multiple weighted tables may be utilized. In this embodiment, in game one, Index #0001 may be selected from Table 1. The processor may then be required to select an index # from a separate table for game 2. Similarly, the processor may be required, for game 3, to select an index # from a third table. Each of the tables may be unique. Again, this process may repeat for a defined period of time, defined number of games, or until a defined number of combinations is available, before referring back to Table 1 and repeating the process. Similarly, separate tables may be utilized for a base game and one or more a bonus games.

Figure 5:
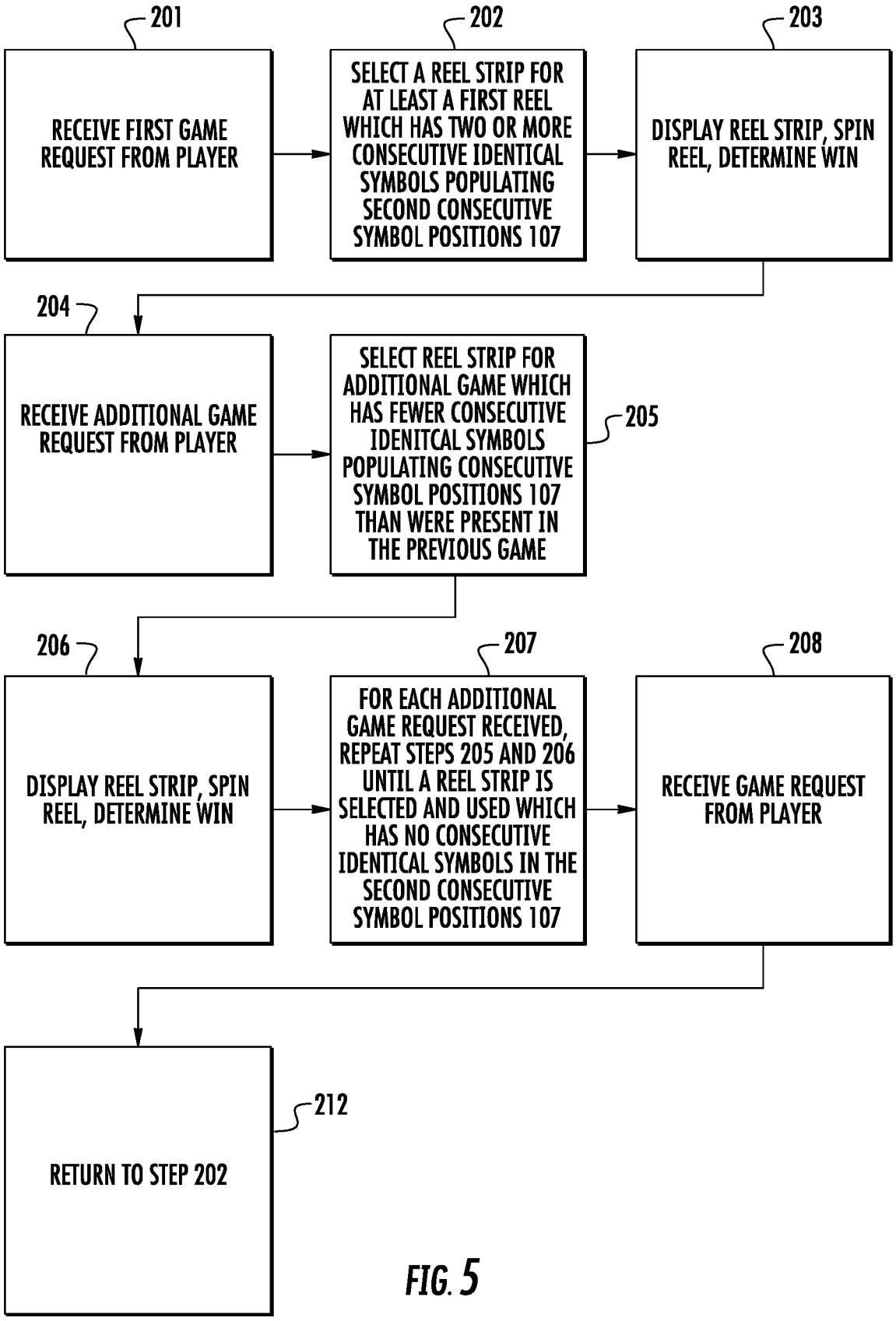
FIG. 5 is a flow chart showing features of embodiments.
Figure 6:
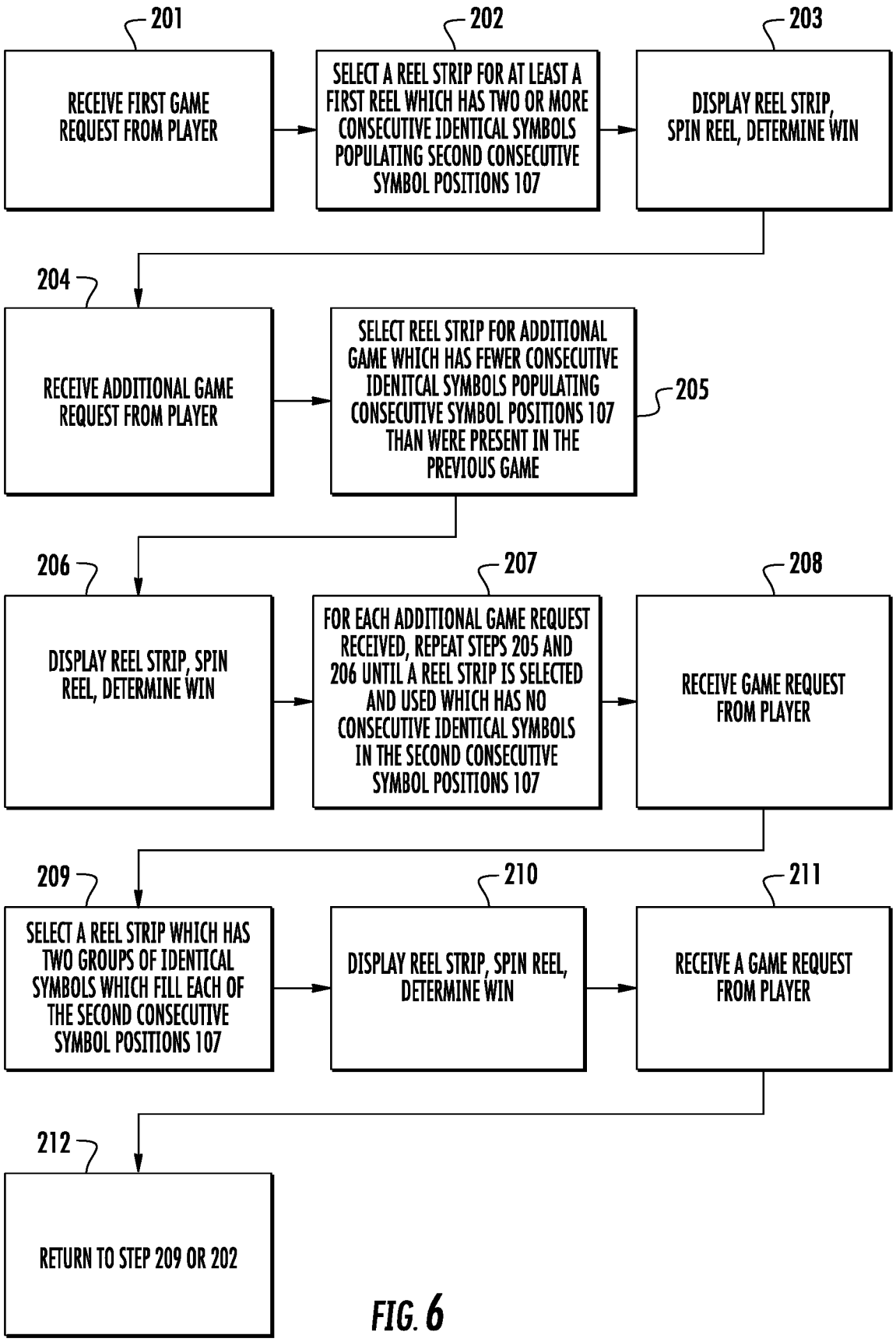
FIG. 6 is a flow chart showing features of embodiments.

In an embodiment of a first game, as illustrated in the flow charts of FIGS. 5 and 6, a participant initiates a play of the game. The processor receives a game request from the participant at operation 201. The processor may then select a reel strip to be displayed on each of the displayed reels using any of the disclosed processes. With regard to a first reel (which may be any reel within the matrix), a first reel strip will be selected for that reel at operation 202. The reel strip may be randomly selected in an embodiment, using any method known in the art, such as via use of a random number generator. The selected first reel strip is configured to have a set of first consecutive symbol positions 106 and a set of second consecutive symbol positions 107, each associated with symbols. In an embodiment, the selected first reel strip has at least two symbols in the second consecutive symbol positions 107 which are consecutive and identical. In an embodiment, the selected first reel strip has a plurality of symbols in the second consecutive symbol positions 107 which are consecutive and identical. In an embodiment, the symbols positioned in the first consecutive symbol positions 106 of the selected first reel strip are not consecutively identical to one another.

In an embodiment, after a reel strip is selected and displayed, at operation 203 (or simultaneous with the selection and/or display thereof) for at least one reel or for each reel, one or more of the reels may spin. The reels may stop randomly, stop in a predetermined position, or may be stopped manually by the participant. If a winning combination of symbols is displayed (and/or obtained through some exercise of skill by the participant), the participant may win a prize. The winning combination may be determined based upon symbols (matching or otherwise) lining up along a predetermined payline, appearing in predetermined matrix positions, or using any other method known in the art.

In an embodiment, a participant initiates play of a second game. The processor receives an additional game request from the participant at operation 204. The processor determines whether the reel strip selected for the first reel during the first game comprised at least two identical symbols in the second consecutive symbol positions 107 and, if so, upon receipt of the second game request, selects a reel strip that has fewer identical symbols in the second consecutive symbol positions 107 than were present in the second consecutive symbol positions 107 in the first game at operation 205. The processor may display the reel strip, spin the reel and determine wins, as described above, at operation 206. Notably, the identical symbols in the reel strip selected for the second game need not be the same identical symbols that were utilized in the reel strip of the first game. As an example, if the reel strip selected for the first game contains 10 identical symbols in 12 second consecutive symbol positions 107, the selected reel strip for the second game may comprise 9 or 8 identical symbols in the 12 second consecutive symbol positions 107. The 9 or 8 identical symbols used in the second game could be the same identical symbols (i.e. 10 identical "A"s in game 1, 9 identical "A"s in game 2), or different identical symbols (i.e. 10 identical "A"s in game 1, 9 identical "Q"s in game 2), from those 10 identical symbols utilized in the first game. This process, in an embodiment, may repeat multiple times at depicted in operation 207. In a particular embodiment, this process may repeat until a reel strip having no identical symbols in the second consecutive symbol positions 107 is selected and displayed for the first reel. If an additional game request is then received, by the processor, at operation 208, the processor may select a reel strip at random or may select a reel strip from a set or subset of reel strips wherein at least two identical symbols populate the second consecutive symbol positions 107, e.g. returning to operation 202, at operation 212. This process may be utilized for each of the reels in the matrix.

In an embodiment, for at least one game, a reel strip is selected for at least one reel (in an embodiment, the first reel) wherein at least two groups of consecutive identical symbols are displayed within the second consecutive symbol positions 107 at operation 209. The processor may display the reel strip, spin the reel, and determine a win at operation 210, receive a game request at operation 211, and return to step 209 or 202 at operation 212. For example, if the reel strip contains thirteen second consecutive symbol positions 107, five consecutive identical symbols 108 may populate five of the symbol positions and eight other identical symbols 109 may populate the other eight symbol positions (see reel strip 105 in FIG. 1). Similarly, if the reel strip contains thirteen second consecutive symbol positions 107, four consecutive identical symbols may populate four of the symbol positions 107, five other identical symbols may populate five of the symbol positions 107, and four additional symbols (optionally, randomly selected) which are not necessarily identical may populate the remaining symbol positions 107. Furthermore, if the reel strip contains thirteen second consecutive symbol positions 107, four consecutive identical symbols may populate four of the symbol positions 107, five other identical symbols may populate five of the symbol positions 107, and four additional identical symbols may populate the remaining four symbol positions 107, such that three groups of identical symbols exist within the second consecutive symbol positions 107. In an embodiment, the at least two groups of consecutive identical symbols fill all of the positions within the second consecutive symbol positions 107, as illustrated in FIG. 1, reel strip 105.

In an embodiment, a reel strip having at least two groups of consecutive identical symbols within the second consecutive symbol positions 107 is selected for the game following the game wherein a reel strip that has no consecutive identical symbols in the second consecutive symbol positions 107 is utilized. If an additional game request is then received by the processor, the processor may select a reel strip at random or may select a reel strip from a set or subset of reel strips wherein at least two identical symbols populate the second consecutive symbol positions 107.

In an embodiment, illustrated in FIG. 1, each reel strip shown may be used in the same reel for successive games. For example, reel 1, game 1 may be illustrated by reel strip 101, wherein the second consecutive symbol positions 107 comprise 13 symbol positions, 12 of which contain identical Q's. Reel strip 102 may represent reel 1, game 2, comprising fewer identical symbols (9 identical Q's) within the 13 second consecutive symbol positions 107. Similarly, reel strip 103 may represent reel 1, game 3, comprising fewer still identical symbols (7 identical Q's) within the 13 second consecutive symbol positions 107. Reel strip 104 may represent reel 1, game 4, comprising no identical symbols within the 13 second consecutive symbol positions 107. Reel strip 105 may represent reel 1, game 5, comprising two groups (5 identical J's and 8 identical A's) within the 13 second consecutive symbol positions 107. For reel 1, game 6, reel strip 101 or any other reel strip having at least two consecutive identical symbols within the 13 second consecutive symbol positions 107 could be selected. The process could then repeat until no further game requests are received from the user.

Figure 10:
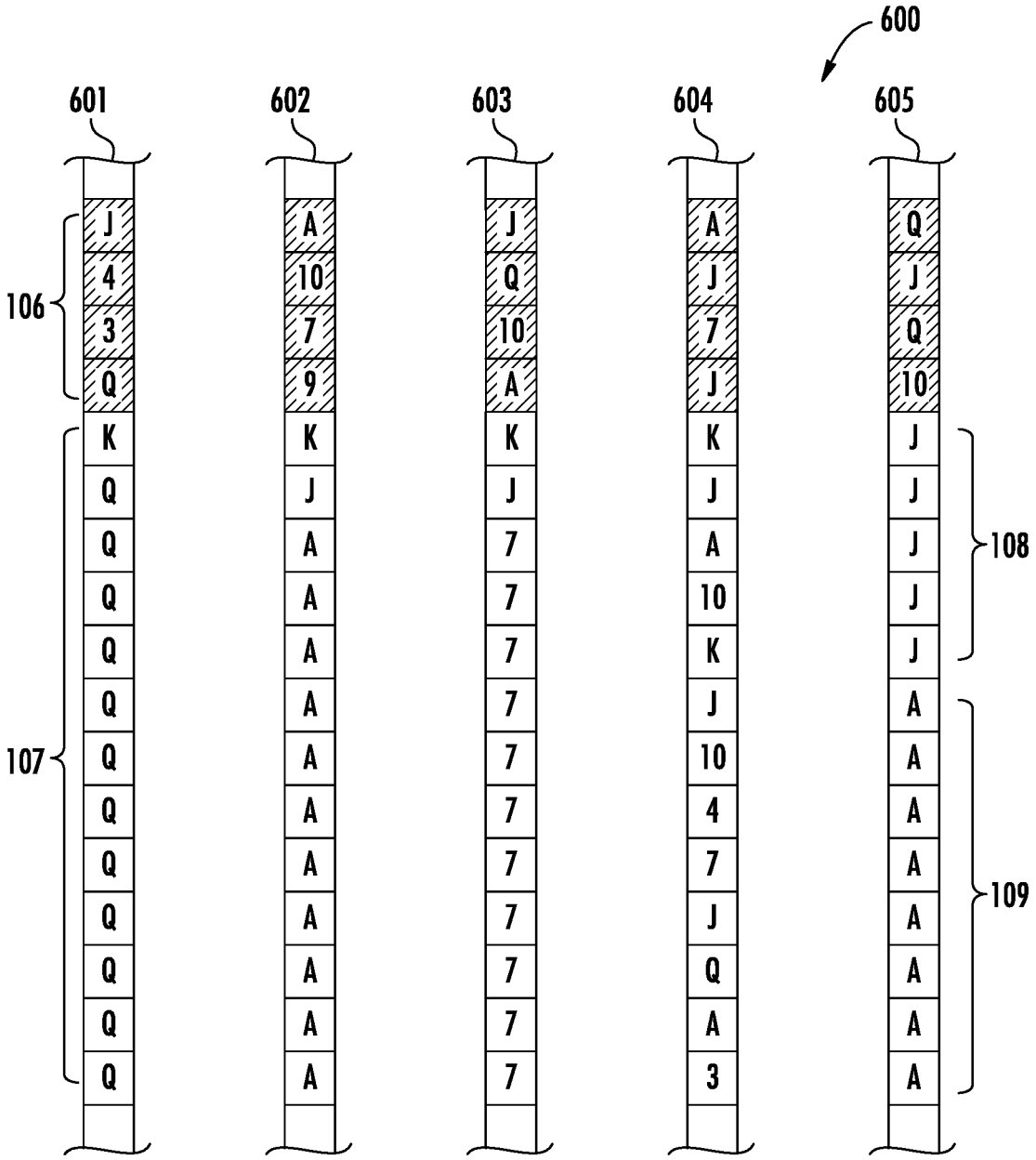
FIG. 10 is a schematic representation of reel strips in an embodiment of the present invention.

In another illustrative embodiment, shown in FIG. 10, reel 1, game 1 may be illustrated by reel strip 601, wherein the second consecutive symbol positions 107 comprise 13 symbol positions, 12 of which contain identical Q's. Reel strip 602 may represent reel 1, game 2, comprising fewer identical symbols (11 identical A's) within the 13 second consecutive symbol positions 107. Similarly, reel strip 603 may represent reel 1, game 3, comprising fewer still identical symbols (10 identical 7's) within the 13 second consecutive symbol positions 107. Reel strip 604 may represent reel 1, game 4, comprising no identical symbols within the 13 second consecutive symbol positions 107. Reel strip 605 may represent reel 1, game 5, comprising two groups (5 identical J's and 8 identical A's) within the 13 second consecutive symbol positions 107. For reel 1, game 6, reel strip 601 or any other reel strip having at least two consecutive identical symbols within the 13 second consecutive symbol positions 107 could be selected. The process could then repeat until no further game requests are received from the user.

Figure 11:
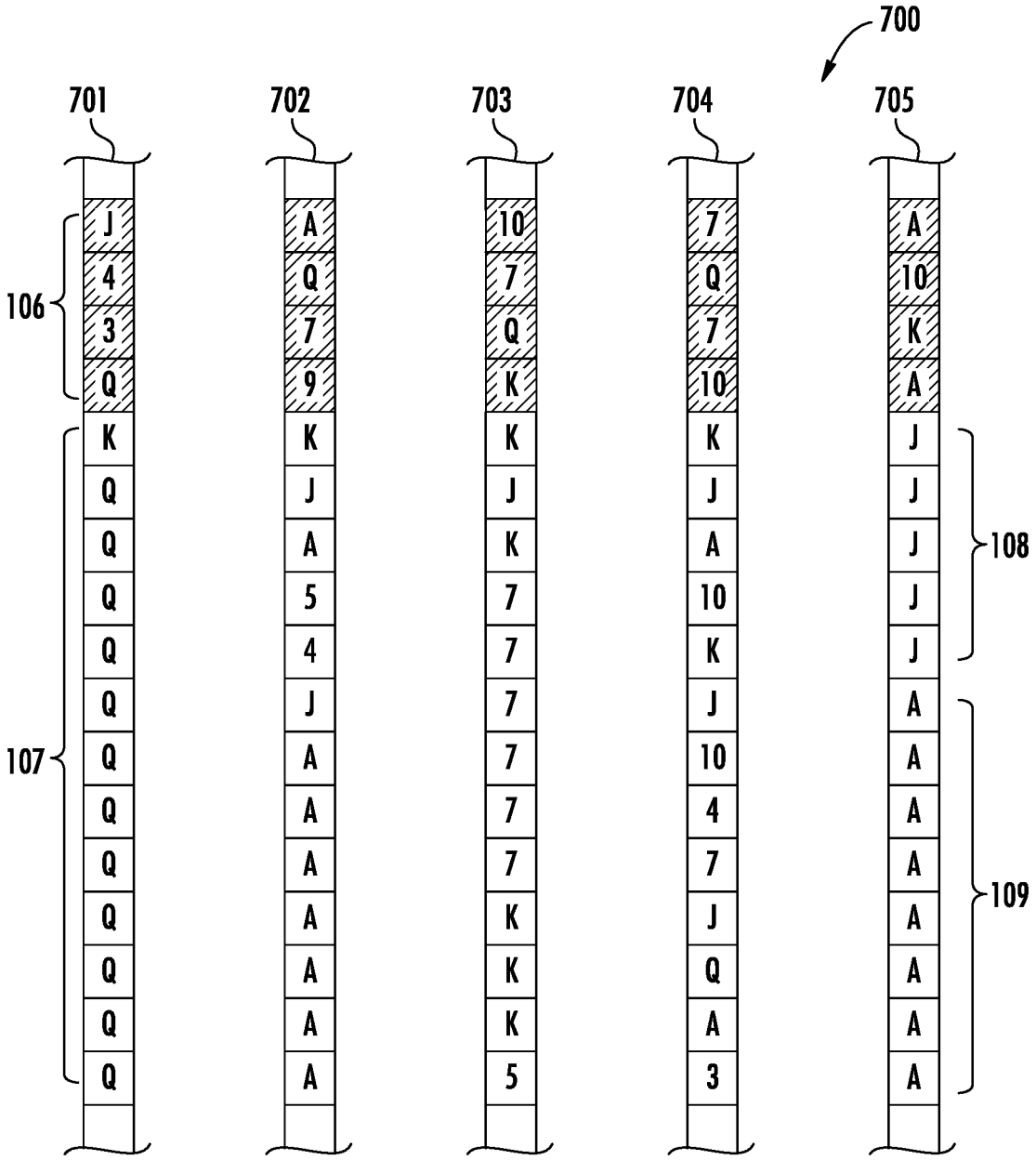
FIG. 11 is a schematic representation of reel strips in an embodiment of the present invention.

In yet another illustrative embodiment, shown in FIG. 11, reel 1, game 1 may be illustrated by reel strip 701, wherein the second consecutive symbol positions 107 comprise 13 symbol positions, 12 of which contain identical Q's. Reel strip 702 may represent reel 1, game 2, comprising fewer identical symbols (7 identical A's) within the 13 second consecutive symbol positions 107. Similarly, reel strip 703 may represent reel 1, game 3, comprising fewer still identical symbols (6 identical 7's and 3 identical K's) within the 13 second consecutive symbol positions 107. Reel strip 704 may represent reel 1, game 4, comprising no identical symbols within the 13 second consecutive symbol positions 107. Reel strip 705 may represent reel 1, game 5, comprising two groups (5 identical J's and 8 identical A's) within the 13 second consecutive symbol positions 107. For reel 1, game 6, reel strip 701 or any other reel strip having at least two consecutive identical symbols within the 13 second consecutive symbol positions 107 could be selected. The process could then repeat until no further game requests are received from the user.

In one embodiment, the quantity of consecutive identical symbols on each reel (i.e. reel 1, reel 2, reel 3, etc.) decreases in each successive game, until no consecutive identical symbols are present. In another embodiment, the quantity of consecutive identical symbols on one or some reels (i.e. reel 1, reel 2, reel 3, etc.) decreases in each successive game, until no consecutive identical symbols are present on those reels. In yet another embodiment, the quantity of consecutive identical symbols on each reel (i.e. reel 1, reel 2, reel 3, etc.) decreases in each successive game, but at different rates, until no consecutive identical symbols are present. For example, each reel may begin with ten identical consecutive symbols in a first game, but in game 2, reel 1 may display 9 consecutive identical symbols, reel 2 may display 3 consecutive identical symbols, and reel 3 may display 8 consecutive identical symbols. In still another embodiment, game one may comprise reel 1 having 10 consecutive identical symbols while reels 2 and 3 have no identical symbols. Game two may show reel 1 having 9 consecutive identical symbols, reel 2 having 10 consecutive identical symbols, and reel 3 still having no consecutive identical symbols. Game three may show reel 1 having 8 consecutive identical symbols, reel 2 having 5 consecutive identical symbols, and reel 3 having 10 consecutive identical symbols. It should be understood that any variation of this type is contemplated by the invention.

Figure 13A:
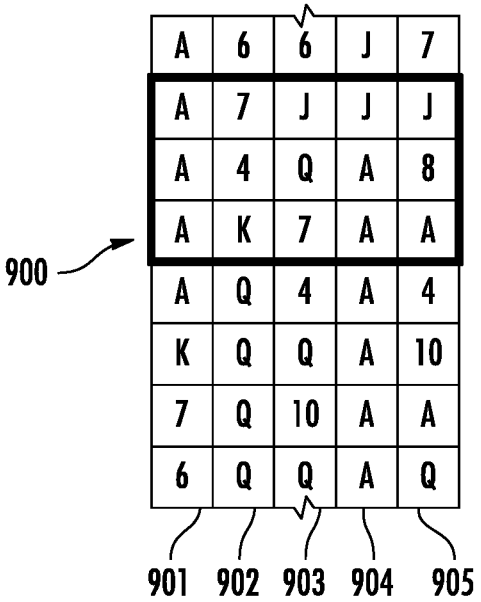
FIGS. 13A-13C are embodiments of the game, as played, in the present invention.
Figure 13B:
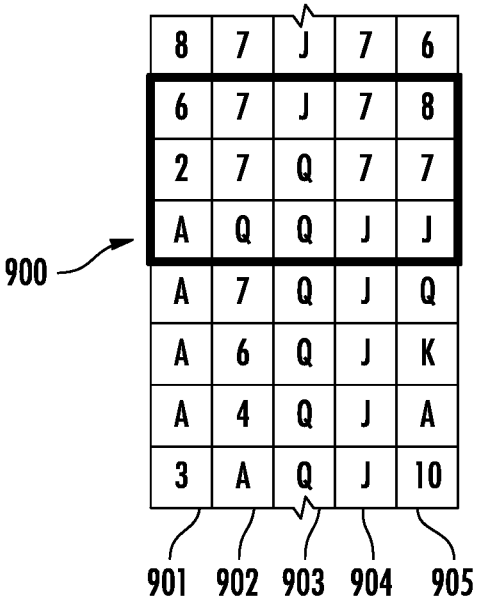
Figure 13C:
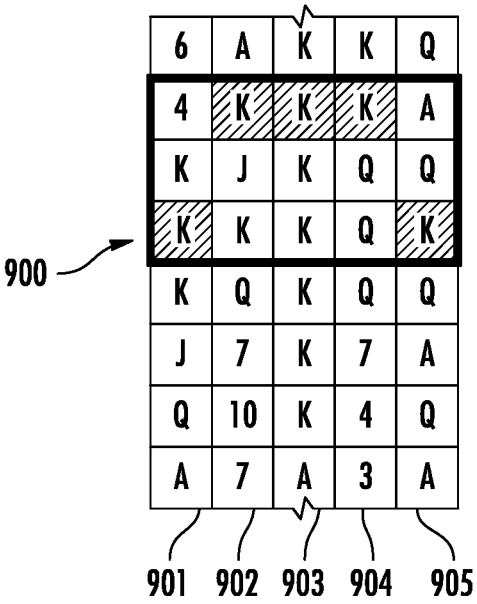

In yet another example, shown in FIG. 13A-C, exemplary successive games are illustrated. The game display 900 illustrates the symbols displayed to the player. The reel strip for each reel, however, has more symbol positions than are shown to the player when the reel stops, as noted above. As the reel "spins," the reel strip advances through the positions shown in the game display 900. In game one (FIG. 13A), when the reels come to rest, reel one 901 displays three consecutive A's in the game display 900, though five consecutive A's are present on the reel strip and would have been seen by the player as the reel was spinning. In game two (FIG. 13B), when the reels come to rest, reel one 901 displays one A in the game display 900, though four consecutive A's are present on the reel strip and would have been seen by the player as the reel was spinning. As is apparent, fewer consecutive identical symbols were present on the reel strip for reel one 901 in game two than were present in game one. In game three (FIG. 13C), when the reels come to rest, reel one 901 displays two K's in the game display 900, though three consecutive K's are present on the reel strip and would have been seen by the player as the reel was spinning. As is apparent, fewer consecutive identical symbols were present on the reel strip for reel one 901 in game three than were present in game two. In an embodiment, it is not necessary that the game display 900 shows fewer consecutive identical symbols in successive games, but only that the reel strip contains fewer consecutive identical symbols in successive games, as the player will be able to see the symbols on the reel strip as the reel spins. In an embodiment, the reel spins at a rate which allows the player to see the symbols that are displayed therein before the reel comes to rest. In another embodiment, the game display 900 shows fewer consecutive identical symbols after the reels have come to rest, for one or more reels, in successive games.

Referring now to reel two 902, shown in FIG. 13A-C, in game one (FIG. 13A), when the reels come to rest, reel two 902 displays no consecutive identical symbols in the game display 900, though four consecutive Q's are present on the reel strip and would have been seen by the player as the reel was spinning. In game two (FIG. 13B), when the reels come to rest, reel two 902 displays two 7's in the game display 900, though three consecutive 7's are present on the reel strip and would have been seen by the player as the reel was spinning. As is apparent, the consecutive identical symbols in game one, reel two and game two, reel two need not be the same identical symbols. In game three (FIG. 13C), when the reels come to rest, reel two 902 displays no identical consecutive symbols in the game display 900 or otherwise.

Referring now to reel three 903, shown in FIG. 13A-C, in game one (FIG. 13A), when the reels come to rest, reel three 903 displays no consecutive identical symbols in the game display 900 or otherwise. In game two (FIG. 13B), when the reels come to rest, reel three 903 displays one J and two Q's in the game display 900, though two consecutive J's and six consecutive Q's are present on the reel strip and would have been seen by the player as the reel was spinning. In game three (FIG. 13C), when the reels come to rest, reel three 903 displays three consecutive K's in the game display 900 and a total of seven consecutive K's on the reel strip.

Referring now to reel four 904, shown in FIG. 13A-C, in game one (FIG. 13A), when the reels come to rest, reel four 904 displays one J and two A's in the game display 900, though two consecutive J's and six consecutive A's are present on the reel strip and would have been seen by the player as the reel was spinning. In game two (FIG. 13B), when the reels come to rest, reel four 904 displays one J and two 7's in the game display 900, though five consecutive J's and three consecutive 7's are present on the reel strip and would have been seen by the player as the reel was spinning. In game three (FIG. 13C), when the reels come to rest, reel four 904 displays two consecutive Q's in the game display 900, though three consecutive Q's and two consecutive K's are present on the reel strip and would have been seen by the player as the reel was spinning.

Referring now to reel five 905, shown in FIG. 13A-C, when the reels come to rest, no consecutive identical symbols are displayed in the game display 900 or otherwise for any game. This could be the case for one or more reels, in one or more games, in an embodiment.

At the end of each game, wins may be calculated. For example, at the end of game three (FIG. 13C), a win may be calculated based upon the three K's in the middle of the first row and the K in the bottom left symbol position and the bottom right symbol position (shown as shaded). Any payline known in the art may be utilized to calculate wins. Similarly, any scatter pattern (or other known win methodology) known in the art could be used to calculate wins. Wild or bonus symbols may be utilized within and throughout the game to increase excitement and calculate wins.

In an embodiment, the inventive system may replace some or all of the consecutive identical symbols with another consecutive identical symbol. In some embodiments, the symbol replacement occurs on only one designated reel. In other embodiments, the symbol replacement may occur on any reel. In still another embodiment, the symbol replacement may occur on multiple reels.

In an embodiment, the consecutive identical symbols are placeholder or mystery symbols that will be replaced with another consecutive identical symbol. In an embodiment, the replacement does not occur until after the reels have stopped spinning. In an embodiment, the system displays a visual indicator of the fact that a symbol replacement is imminent.

In an embodiment, the replacement of some or all of the consecutive identical symbols with another consecutive identical symbol is a smart replacement. In this smart replacement schema, the system may do one or more of the following: evaluate the symbols that are displayed after the reels have stopped for potential winning combinations, determine which original symbols should be replaced for the greatest potential win, determine which replacement symbols should replace those original symbols for the greatest potential win, and replace the symbols accordingly. The smart replacement schema may evaluate one or more outcomes in order to determine the most advantageous replacement for the participant.

In an embodiment, the replacement feature only occurs when a triggering event occurs. The triggering event may comprise any trigger known in the art. In an example, the trigger may comprise a symbol or set of symbols with different colors. In another example, the trigger may comprise a box, circle, or frame that surrounds, highlights or illuminates certain reels or symbols. In another example, the trigger may be the display of a certain symbol. The trigger, in an embodiment, may be the fact that the participant has won a certain number of games, obtained a certain number of points or monetary value, lost a certain number of games, or lost a certain number of points or monetary value. In an embodiment, the trigger may be based upon the number of games played in total or by the individual participant. In another embodiment, the trigger may be based upon a timer.

In another embodiment, if none of the displayed consecutive identical symbols are involved in a winning outcome, those consecutive identical symbols become "locked" in place for a certain period of time or number of games. In an embodiment, the symbols are locked in place until they are involved in a winning outcome. In an embodiment, the locking in place means that the reel does not spin and the displayed symbols do not change. In another embodiment, the locking in place means that the particular reel strip is not replaced between games, but may still spin on the reel and different symbols within the reel strip may be displayed when the reels stop spinning. In an embodiment, a lock symbol is displayed when this feature is activated. In an embodiment, the locking feature only occurs when a triggering event, as discussed above, occurs.

Figure 15:
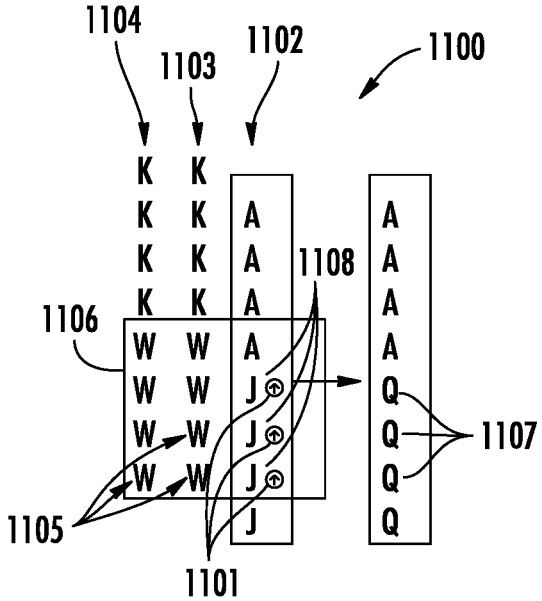
FIG. 15 is a schematic representation of reel strips in an embodiment of the present invention.

In an embodiment (FIG. 15), a particular reel strip upgrade 1100 is shown. In this embodiment, certain of the consecutive identical symbols within a reel strip 1102 may contain upgrade indicators (i.e. different color, different shape, arrow, star, encircled, etc.) 1101 which, when displayed, may cause the processor to upgrade, or substitute, some or all of the consecutive identical symbols 1108 with a symbol having a higher value 1107. For example, the upgrade could be hierarchical. If "jacks" are displayed as the consecutive identical symbols 1108 when the reels stop and those "jacks" have the required upgrade indicator 1101, the processor may upgrade them to "queens," 1107 "kings," or "aces," each being one step up in the hierarchy or having a greater point/monetary value. In some embodiments, the upgrade occurs if the consecutive identical symbols with upgrade indicators 1101 are positioned next to one or more wilds 1105, in a row or column. The wilds could, in some embodiments, be in the same reel strip 1102 or within different reel strips 1103 and/or 1104. In some embodiments, the processor enables the consecutive identical symbols to be displayed with upgrade indicators 1101 when they are positioned near one or more wilds. In other embodiments, the upgrade indicators 1101 are present on the consecutive identical symbols on the reel strip 1102 before its selection by the processor. In some embodiments, all consecutive identical symbols on the reel strip are upgraded in accordance with this feature. In other embodiments, only the consecutive identical symbols that are displayed to the participant within the game display 1106 are upgraded in accordance with this feature.

In a particular embodiment, if the consecutive identical symbols have upgrade indicators 1101, the relevant symbols are upgraded one level within the hierarchy. This may or may not be displayed to the participant. The processor then determines whether the participant has won any points/monetary value in the game. If not, the processor may then upgrade the relevant symbols another level within the hierarchy. Again, this may or may not be displayed to the participant. The processor then determines whether the participant has won any points/monetary value. If not, the processor may repeat the process until the participant wins a game or until there are no further possible upgrades.

In yet another embodiment, the system may upgrade one or more consecutive identical symbols without requiring any upgrade indicator or other visual indicator in order to make the upgrade. The upgrade may be random or may require a hidden trigger. The trigger could be any known in the art. Similarly, the upgrade may occur based upon the display or presence of a particular symbol. For example, the display or presence on a reel strip of a "J" (or any other symbol) within the consecutive identical symbols in any game could trigger one or more upgrade actions.

Advantageously, the inventive system, device and game provides a novel and stimulating variation on the basic reel-based slot game, yet complies with the strict regulatory restrictions set forth for the gaming industry. In an ordinary reel-based slot game, the reels (or the reel strips) do not change for each game played. The only variation in the game is where the reels will stop, thereby limiting the number of possible player experiences. Thus, game manufacturers attempt to distinguish their games based upon the theme of the game or vivid graphics—jungle animals or green leprechauns. The underlying method of playing the game remains the same, however.

In the present invention, the consecutive identical symbols that appear on the various reel strips provide a new layer of excitement to the player. When the player sees a particular symbol repeating as the reel spins, and particularly if the player sees the same identical symbol on another reel within the set, the player thinks there is a higher likelihood of a potential win and becomes excited. As the reels slow and the symbols lock into place, the player waits with anticipation to see if any symbols will match up, be positioned along the various paylines, or will fall into various other winning combinations. This provides a significantly higher level of player excitement because it provides a greater expectation of winning.

Additionally, the inventive system is accompanied with new features and more unusual features than traditional games offer. For example, no existing games provide the highest number of identical consecutive symbols as soon as you sit down, gradually reducing the number of identical consecutive symbols until none are shown, and then restarting the process again, providing a high number of consecutive identical symbols. Further, the inventive system also mixes in groups of identical symbols within a single reel, a feature that provides an even higher level of player excitement because with two or more groups of identical symbols, the player may become excited about winning with either of the identical options. The player feels that they have an even greater likelihood of winning due to the consecutive groups of identical symbols, even if the groups are not consecutive with one another.

Bonus Game

Figure 16:
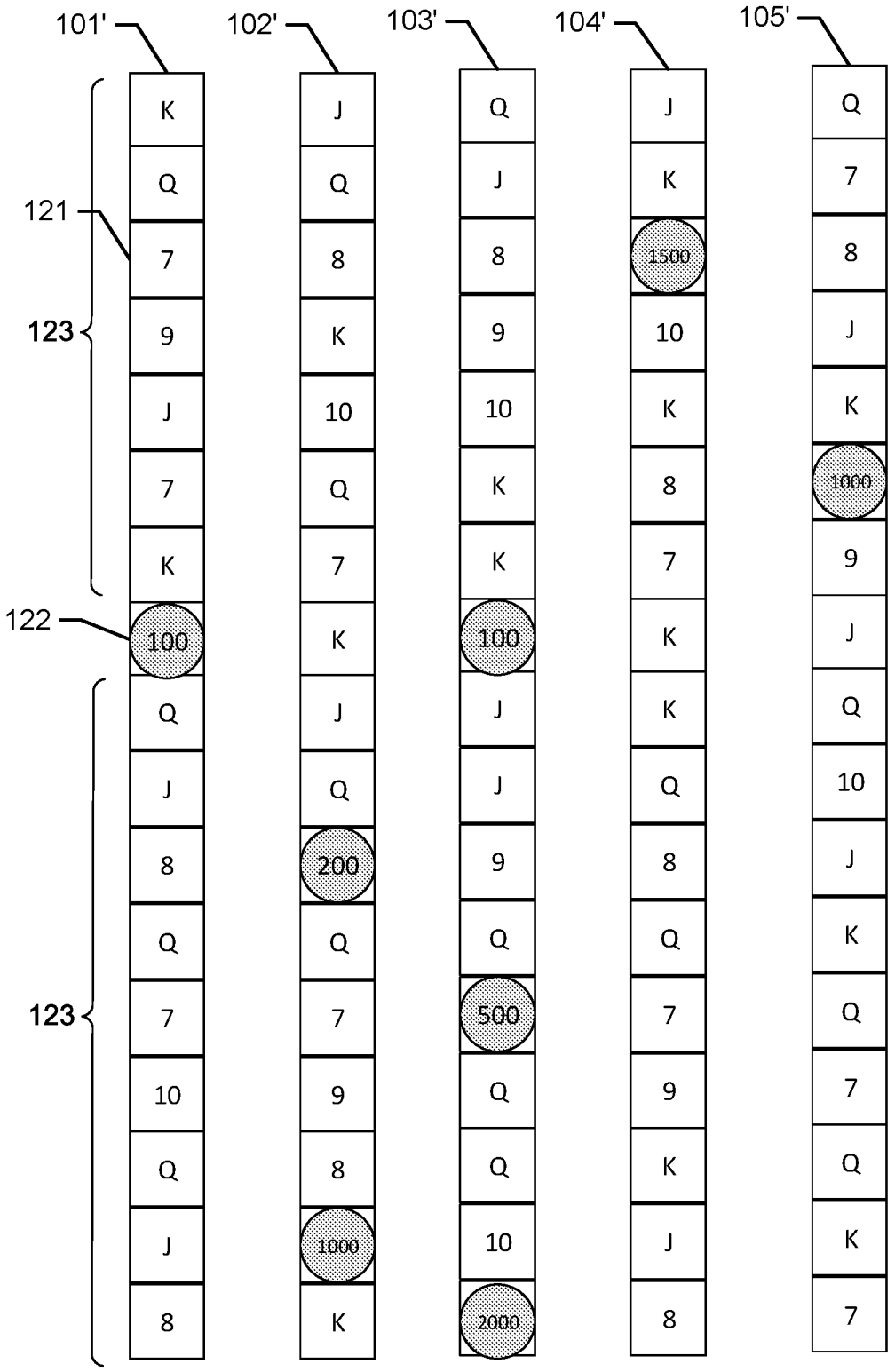
FIG. 16 is a schematic representation of reel strips in an embodiment of the present invention.
Figure 23:
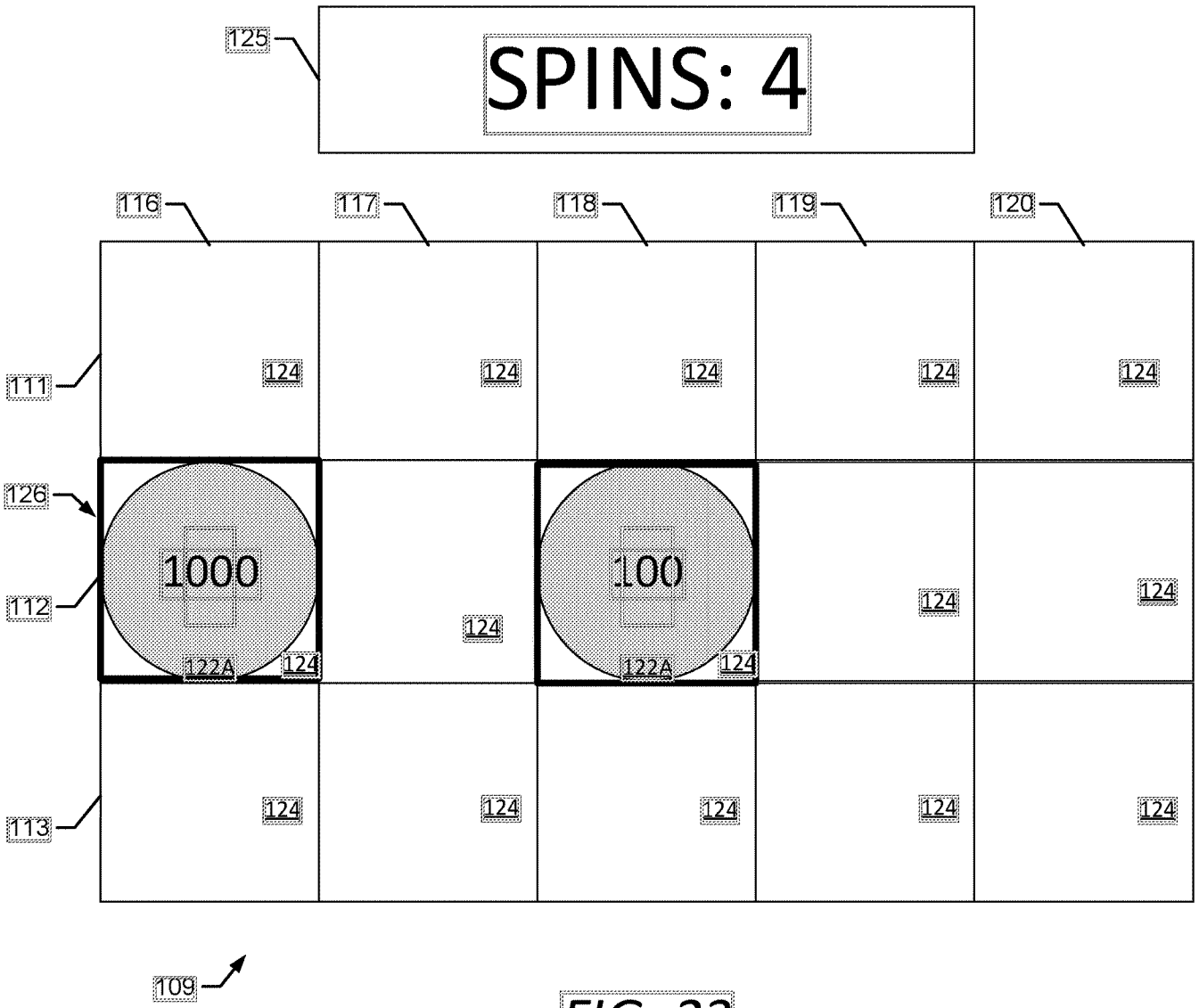
FIG. 23 is an example bonus game with bonus symbols after clearing the symbols positions in an embodiment of the present invention.
Figure 24A:
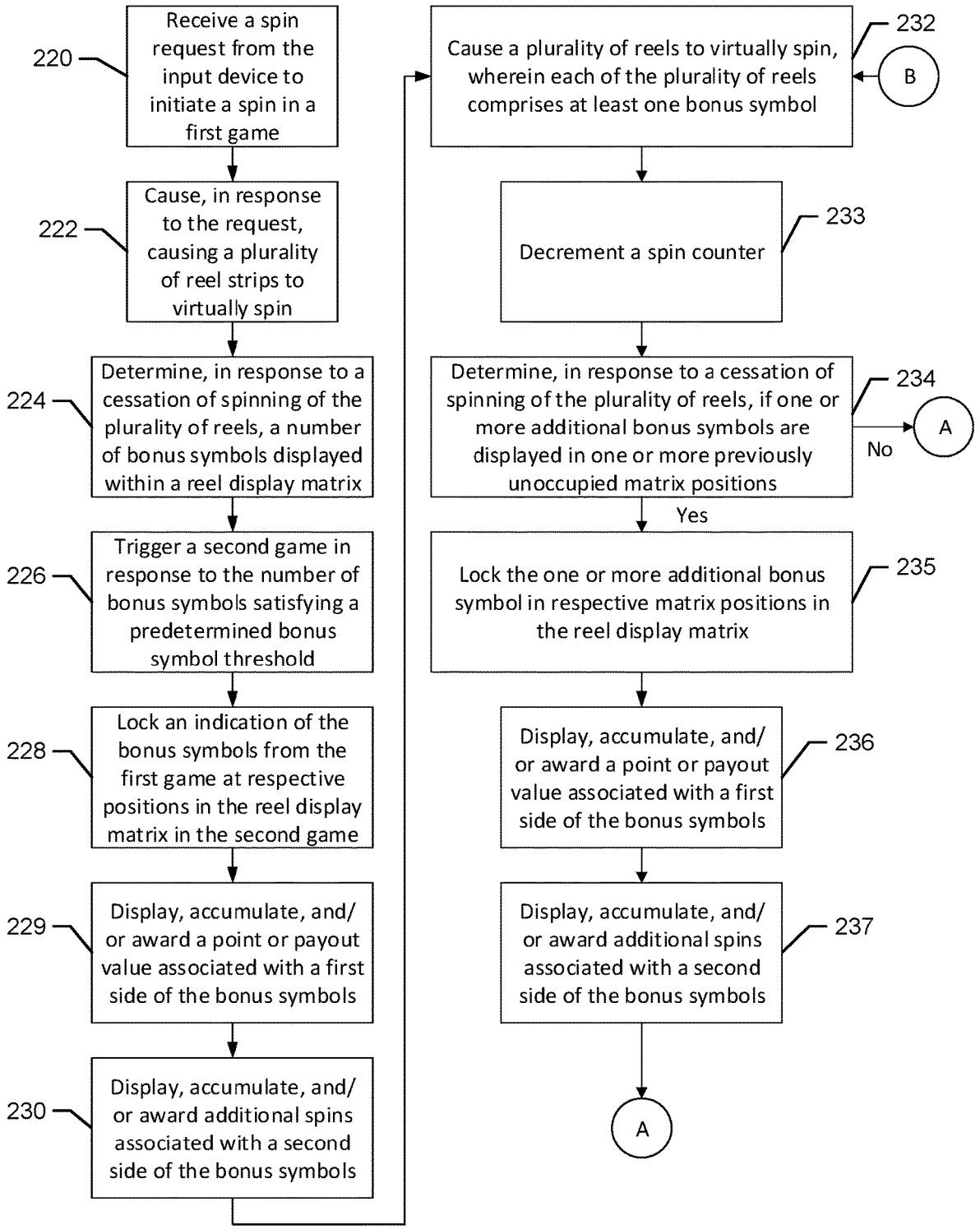
FIGS. 24A and 24B are a flow charts showing features of embodiments of the bonus game.
Figure 24B:
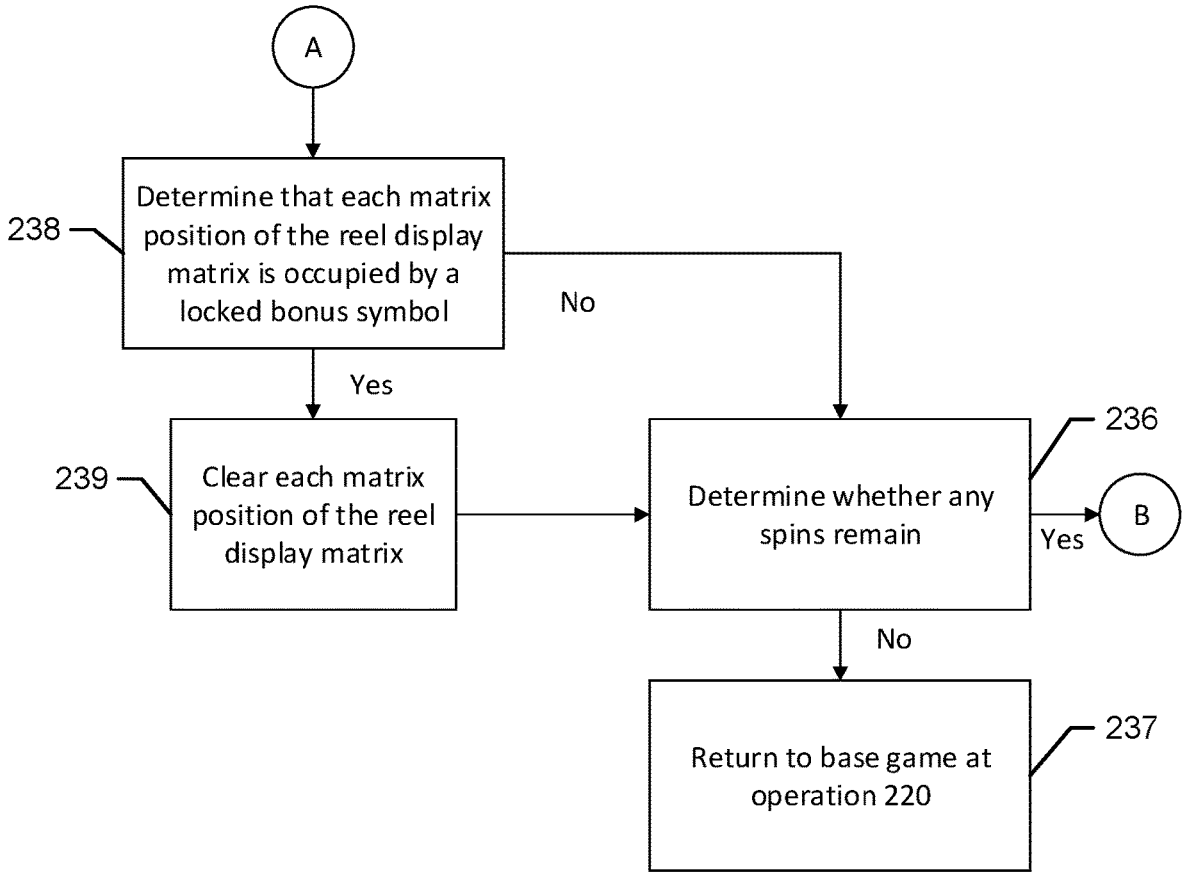

In some example embodiments, one or more of the reels strips 101, 102, 103, 104, and 105 may include a bonus symbol, e.g. a symbol predetermined to trigger a second game, such as a bonus game. While the term "bonus symbol" is used herein, it should be understood that the bonus symbol may comprise any designated symbol known in the art. In one such embodiment, the bonus symbols may be the identical consecutive symbols, as discussed above with regard to the "stacked symbol" feature. In other embodiments, the bonus symbol may be displayed as the word "BONUS" or a platinum coin, gold coin, silver coin, bronze coin, or any other symbol. In an example embodiment, reel strips 101', 102', 103', 104', and 105' may include a set of first symbols 123, or base game symbols, as discussed above, and one or more bonus symbols 122 in the various symbol positions 121, as depicted in FIG. 16. FIGS. 17-23 illustrate various stages of an exemplary bonus game to facilitate a description of the mechanics of the bonus game and FIGS. 24A and 24B illustrate flow charts of the bonus game according to an example embodiment.

As described above, the processor may receive a spin request from the input device to initiate a spin in the first game, e.g. the base game, at operation 220. For example, the user may enter one or more credits via the payment system, described below in reference to FIG. 12, and press a "play" or "spin" touch position on a touch display or a button on a user interface.

In response to the request to initiate the spin, the processor may cause the a plurality of reels to virtually spin on the display at operation 222. In an example embodiment including five reels each having a respective reel strip 101', 102', 103', 104', and 105', the first symbols 123 and bonus symbols 122 may cycle through the matrix positions 127 of the reel display matrix 109 such as through each position of a column 116, 117, 118, 119, 120 from a top row 111, through the middle row 112, to the bottom row 113. In other example embodiments, each matrix position 127 may be associated with a separate reel and respective reel strip 101', 102', 103', 104', and 105', such that in the depicted example of a three by five reel display matrix would include fifteen reels spinning separately. The reels may include distinct reel strips 101', 102', 103', 104', and 105' or may include one or more duplicate reel strips. 101', 102', 103', 104', and 105'.

In some example embodiments, the reels strips 101', 102', 103', 104', and 105' may include the bonus symbols 122 in predetermined symbol positions 121 within the plurality of first symbols 123, such that the bonus symbols 122 are a portion of the reel strips 101', 102', 103', 104', and 105' as stored in memory. In other embodiments, the bonus symbols 122 may be dynamically assigned to one or more symbol positions 121, thereby replacing one or more of the first symbols 123 in one or more of the reel strips 101', 102', 103', 104', and 105', such as in association with each request to initiate a spin. The reels may stop randomly, stop in a predetermined position, or may be stopped manually by the participant, thus ending the virtual spin upon cessation of the spinning of the plurality of reels.

Figure 17:
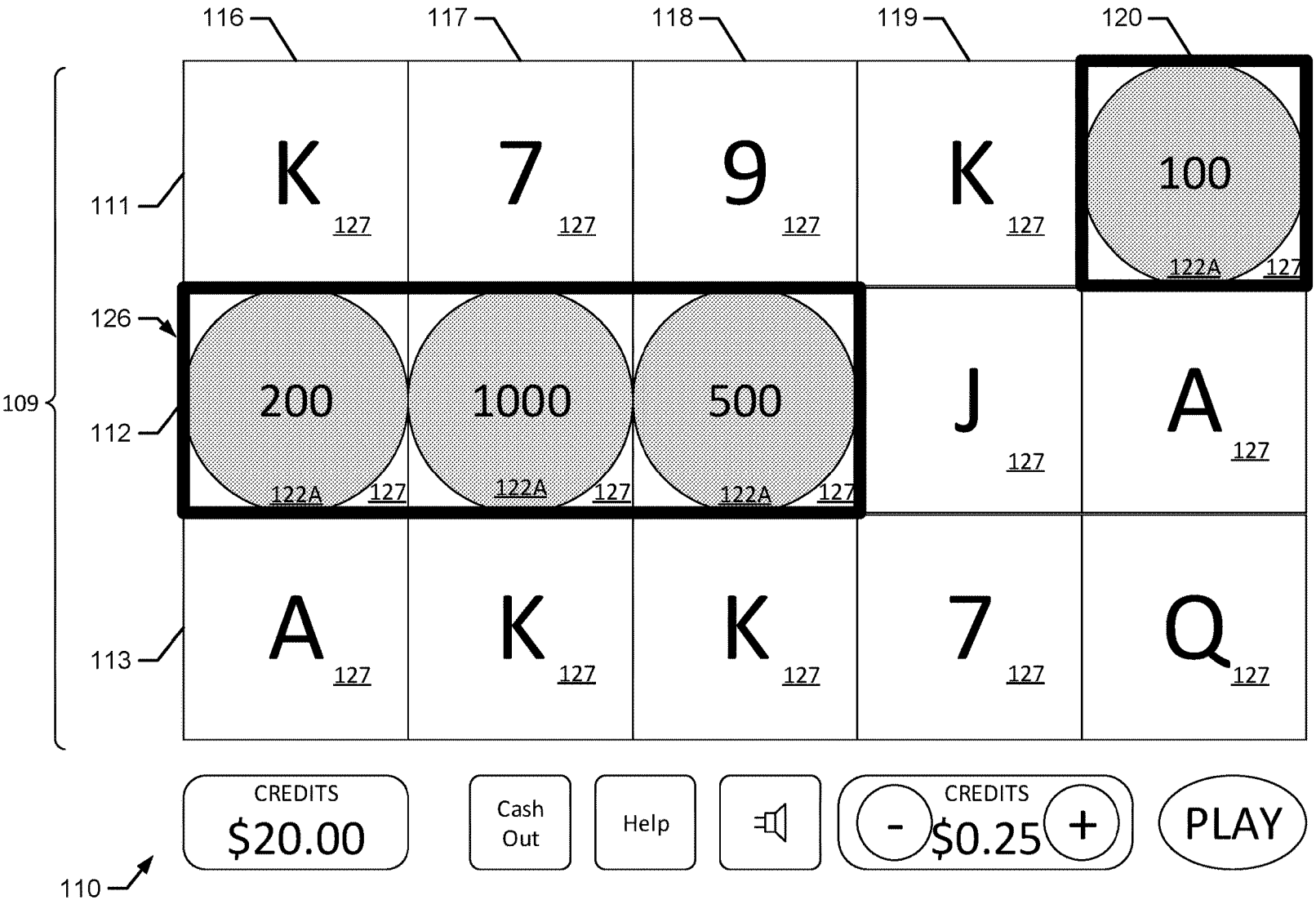
FIG. 17 is an example bonus symbol in a base game in an embodiment of the present invention.

In response to the cessation of spinning of the plurality of reels, the processor may determine a number of bonus symbols 122 displayed within the reel display matrix 109 at operation 224. As depicted in FIG. 17, four bonus symbols 122 are displayed in symbol positions within the reel display matrix 109. In this example, the processor may determine a total number of displayed bonus symbols 122. In some embodiments, the processor may be configured to enable stopping of the reels such that one or more of the symbols occupies only a portion of a matrix position 127. In such an example, the processor may count bonus symbols 122 which are centered in the respective symbol position, occupy more than a predetermined amount of the matrix position 127, e.g. greater than 50 percent or 70 percent, or like.

The processor may be configured to compare the number of bonus symbols 122 displayed within the reel display matrix 109 to a predetermined number of bonus symbols 122, such as one bonus symbol, three bonus symbols, five bonus symbols, or the like. Additionally or alternatively, the processor may determine and compare matrix positions 127 of the bonus symbols 122 to a predetermined bonus configuration, such as three bonus symbols 122 consecutively positioned along a win line, or any other suitable configuration known in the art.

In response to the number of bonus symbols 122 satisfying the predetermined bonus symbol threshold, the processor may trigger a second game, e g. a bonus game at operation 226. Additionally, or alternatively, the bonus symbols 122 may satisfy the predetermined bonus configuration to trigger the bonus game. In the depicted embodiment in FIG. 16, the processor may be configured to trigger the bonus game in response to three bonus symbols 122 being displayed at any matrix position 127 within the reel display matrix 109, as such the four displayed bonus symbols 122 may cause the processor to trigger a bonus game.

In an example, the bonus symbols 122 may comprise a variety of bonus symbols. For example, the bonus symbols 122 could be a combination of first, second, third and fourth bonus symbols. For example, such bonus symbols 122 could comprise platinum coins, gold coins, silver coins, and bronze coins. In such an embodiment, certain types and/or certain numbers of bonus symbols may be required to appear to satisfy the predetermined bonus symbol threshold. Alternatively, certain types and/or certain numbers of bonus symbols could trigger variations on the bonus game. For example, three bronze coins could unlock one or two free spins, whereas three gold coins could unlock five or six free spins. Any variation known in the art could be utilized in this embodiment. For example, the displayed bonus symbols 122, based upon their varied levels, could determine the number or range of possible free spins, the value or range of any multiplier, and/or the value or range of any possible jackpot.

In an embodiment, the type of bonus symbol 122 that is potentially displayed is based upon the participant's bet level. For example, a lower bet level may trigger the possibility of bronze bonus coins, whereas a higher bet level may trigger the possibility of gold or platinum bonus coins, providing the above-noted benefits associated with such bonus symbols. Similarly, the participant's bet level may trigger the use of different reel strips which display more bonus triggers and/or more free spins. For example, a lower bet level may trigger the system to use a first reel strip which displays 10 potential bronze bonus triggers and 10 potential free spins. A lower bet level, however, may trigger the system to use a second reel strip which displays 20 potential gold bonus triggers and 15 potential free spins. Any variation on the type, number or value of the bonus elements in encompassed herein.

In an example embodiment, the processor may be configured to lock or freeze one or more bonus symbols 122 from the first game at respective matrix positions 127 in the reel display matrix 109 in the second game at operation 228. The bonus symbols 122 may be locked in the position in which they were displayed when the reels stopped, or some other predefined symbol position. For example, the bonus symbols 122 may cascade downward, left, or right. The bonus symbols 122 may move to the end of a row or the bottom of a column within the matrix. Similarly, the bonus symbols 122 may move one position up, down, right or left. Any configuration known in the art may be utilized to determine which symbol position a bonus symbol 122 may be locked into.

Figure 18:
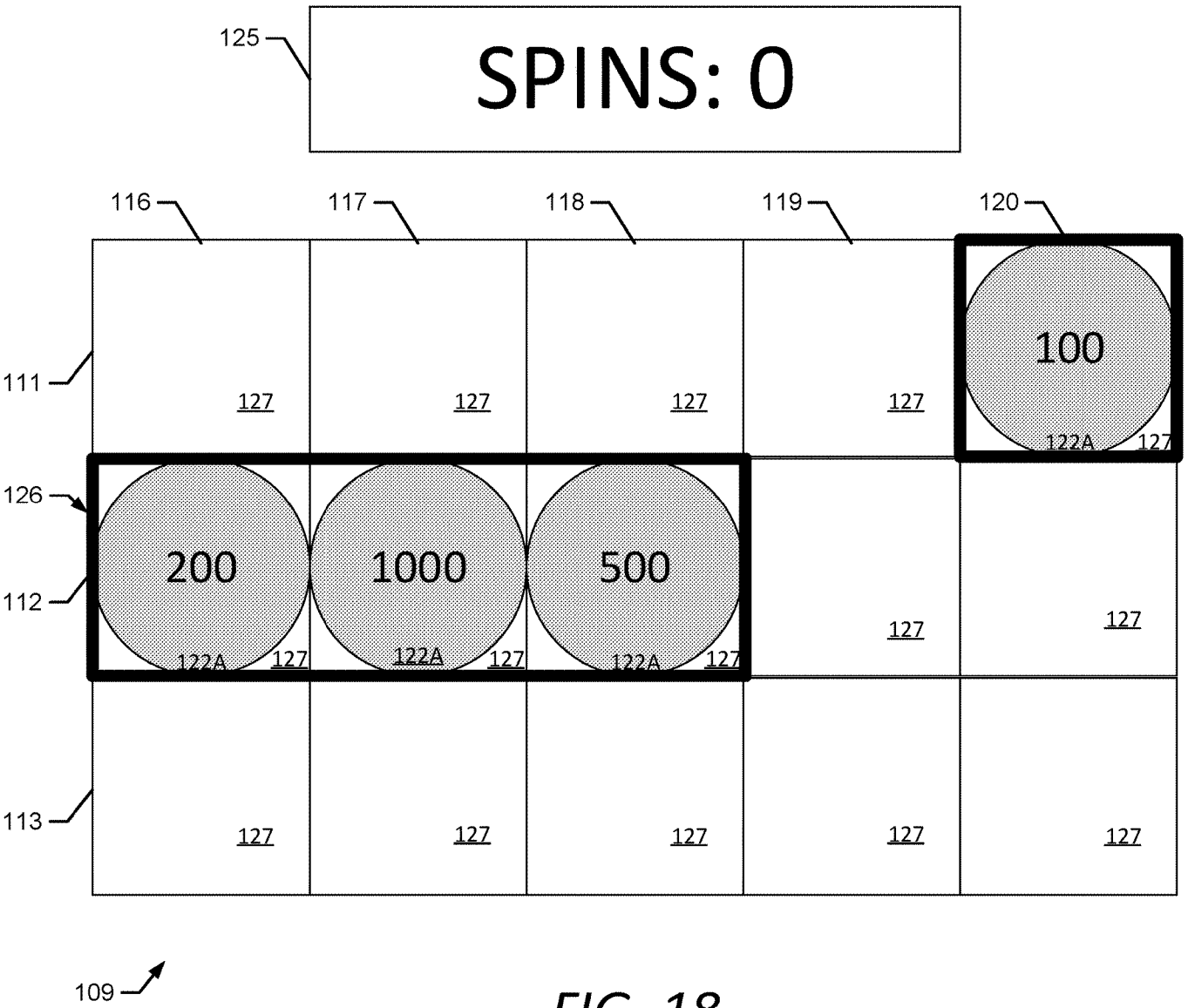
FIG. 18 is an example bonus game initial display in an embodiment of the present invention.

Continuing with the example from FIG. 17 the first symbols 121 may become inactive and/or may not be displayed at all during the bonus game, as depicted in FIG. 18. The first symbols 121 may be greyed out, may become miniaturized, or may be removed entirely from the matrix, leaving one or more empty symbol positions.

Figure 25:
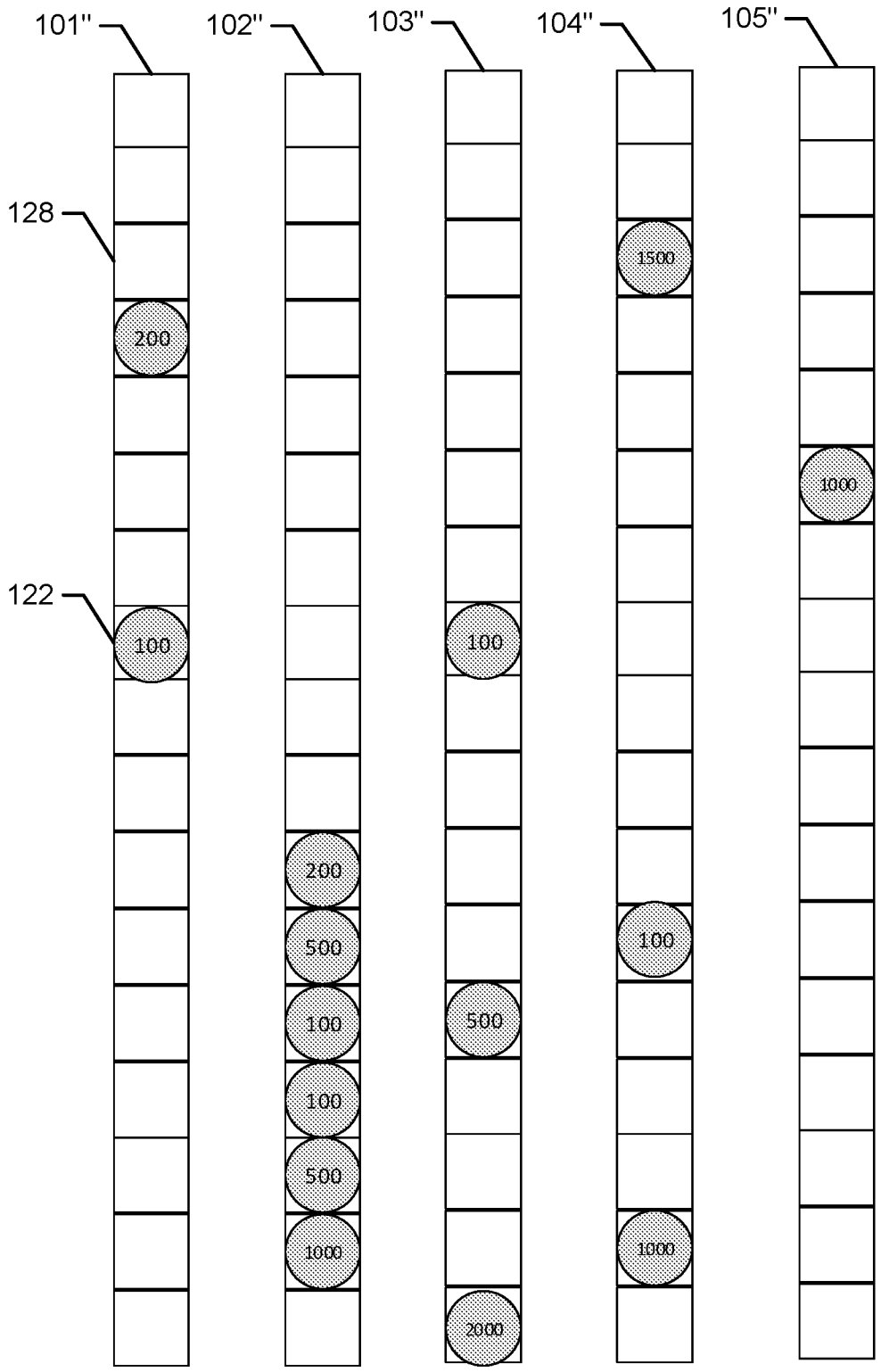
FIG. 25 is a schematic representation of reel strips of a bonus game in an embodiment of the present invention.

In some examples, the bonus game may utilize the same reel strips 101', 102' 103', 104', and 105' as used in the first game, e.g. the base game, with the base game symbols 121 inactive and/or not displayed. In other embodiments, the bonus game may include one or more unique bonus reel strips 101", 102" 103", 104", and 105", as depicted in FIG. 25. The bonus reel strips 101", 102" 103", 104", 105" may include one or more bonus symbols 122 and a plurality of blanks 128 or placeholder positions with no symbol. In one such embodiment, the blanks 128 may include obscured symbols, such as black symbols on a black background, these obscured symbols may be partially visible during bonus game play, such as during an background animation. For example, a subsequent bonus symbol 122 may stop within the reel display matrix 109 during a spin in the bonus game, as described below. A fire animation may be generated about the bonus symbol for a desirable visual effect. In symbol positions 121 without a bonus symbol 122, the outline of the blacked out symbol may be visible over, e.g. in front of, the animation to provide a dramatic visual effect. In some embodiments, the bonus symbols 122 may be stacked within a reel strip, as shown in reel strip 102".

In an embodiment, certain locked bonus symbols 122 may initially be displayed as a particular subtype (for example, a bronze coin), but may thereafter be altered to become a different bonus symbol subtype (a silver coin, for example). This subtype alteration may occur during a visual spinning of the coins, in an embodiment. The altered subtype may have a different bonus value, number of associated free spins, value of multiplier, and/or value of jackpot. In an embodiment, the system may permit a plurality of subtype alterations during bonus rounds. In an embodiment, the subtype alterations may result in bonus symbols of higher or lower levels.

Figure 19:
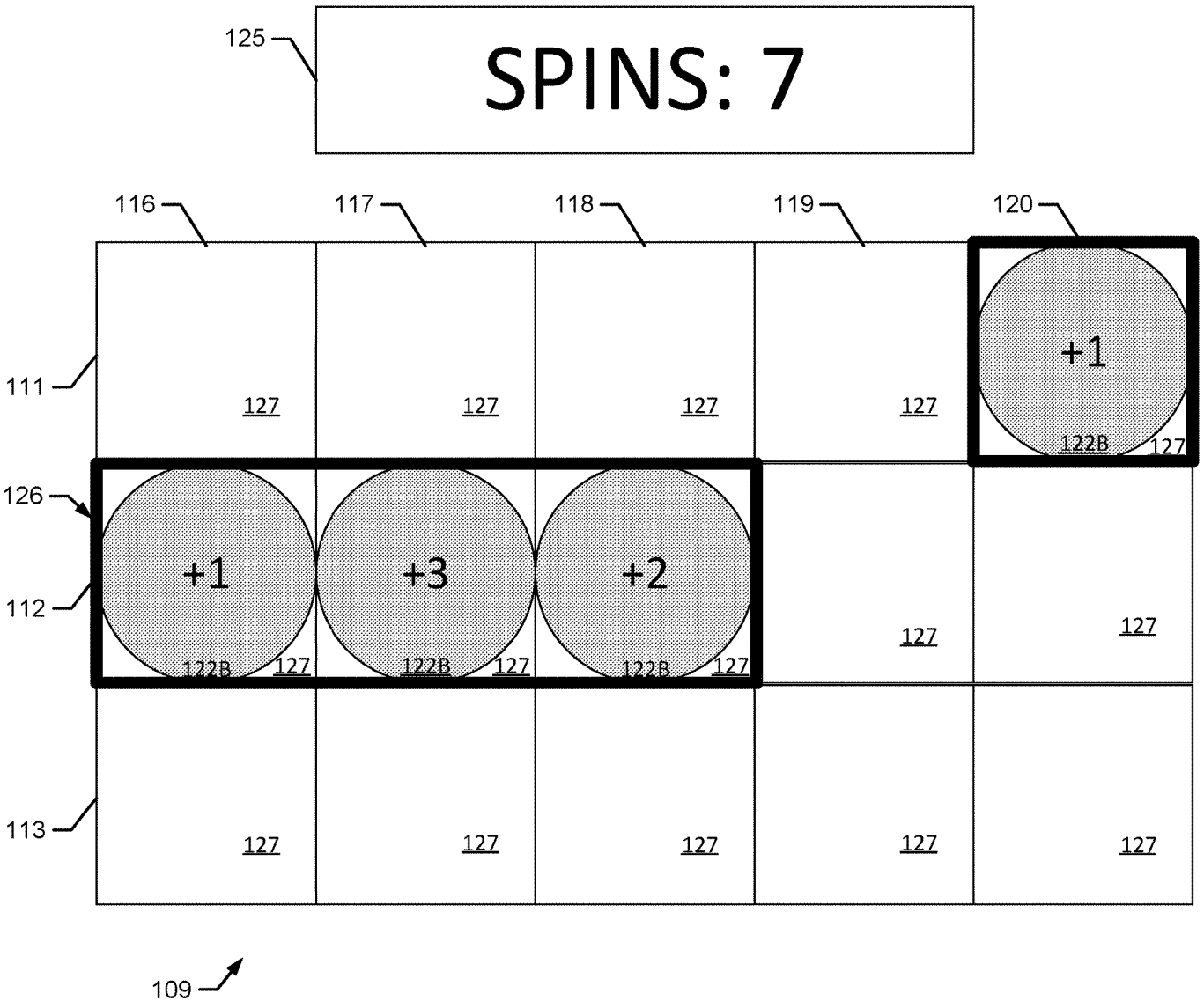
FIG. 19 is an example bonus game showing a second side of the bonus symbols in an embodiment of the present invention.

The bonus symbols 122 may include a point value, a payout value, a number of additional spins (in the bonus game and/or the base game), and/or any other suitable award type. In some embodiments, the bonus symbols 122 may include a first side 122A including a first indicia indicating a first award type and a second side 122B including a second indicia indicating a second award type. For example, the bonus symbol 122 may be a coin or other object with at least two sides. The bonus symbol 122 may display the first side 122A indicating a point or payout value during the spin cycle and subsequent stop. The point value, other payout value, or the like may be accumulated, displayed and/or awarded to the player, at operation 229. The bonus symbol 122 may then flip to, or otherwise display, the second side 122B indicating a number of additional spins. In the depicted example of FIGS. 17 and 18, the bonus symbols 122 include first sides 122A including point values of 200, 1000, 500, and 100, respectively. In FIG. 19, the bonus symbols 122 have flipped to display the second side 122B, which indicate additional spins of 1, 3, 2, and 1, respectively. In an embodiment, the additional spins may be accumulated, displayed and/or awarded to the player at operation 230.

In an embodiment, certain bonus symbols 122 may flip to the second side, but not immediately identify a point value. In this embodiment, for example, the designated bonus symbol may flip to display a separate "spinner" or other visual display which allows the system to rotate through various potential point values before settling on the final point value. For example, the flipped display may rotate certain point values vertically or horizontally, within the display position, or superimposed in a larger fashion. The flipped display may rotate through point values of 200, 1000, 500, and 100, eventually settling on a point value of 500. Likewise, the flipped display may rotate through point values of 200, 1000, 500, 100, and additionally rotate through free spin options, such as "2 free spins," "3 free spins," and "10 free spins." Likewise, the flipped display may rotate through point values, free spin options, and/or jackpot options, such as "mini jackpot," "minor jackpot," "major jackpot," and "grand jackpot."

In another embodiment, the system may display one or more lines of inactive symbols during the bonus rounds. The inactive lines may be displayed as greyed out or in muted colors, in an embodiment, or may use any other visual indication to show that the lines are inactive. The inactive lines may display and/or rotate various symbols to increase participant excitement regarding activating such lines. The inactive lines may require a certain subtype and/or number of bonus symbols 122 to be displayed in order to unlock such lines. For example, if 4 bronze coins are displayed, the first inactive line may be unlocked. Those symbols and symbol positions are then active in the remaining bonus rounds. In another example, if 6 silver coins are displayed, a second inactive line may be unlocked, activating those symbols and symbol positions for the remaining bonus rounds.

In an embodiment, certain bonus symbols 122 may trigger one or more additional bonus games. The additional bonus games may be the same as or different from those described herein.

In some example embodiments, the display may include a spin counter 125. The spin counter 125 may be the same spin counter used in the base game or a separate spin counter 125. In the bonus game, the spin counter 125 may start at zero spins, as illustrated in FIG. 18. The spin counter 125 may be updated based on the additional spin values indicated on the second side 122B of each of the bonus symbols 122. In some instances, the additional spins may be cumulative, such that the number of additional spins for each bonus symbol 122 is added to the indicated number of spins of the spin counter 125. In another embodiment, the number of additional spins may be capped at a certain level or may reset upon each new spin. In a particular example embodiment, the processor may not include a maximum limit for additional spins and additional spins may be accumulated until the game ends.

Figure 20:
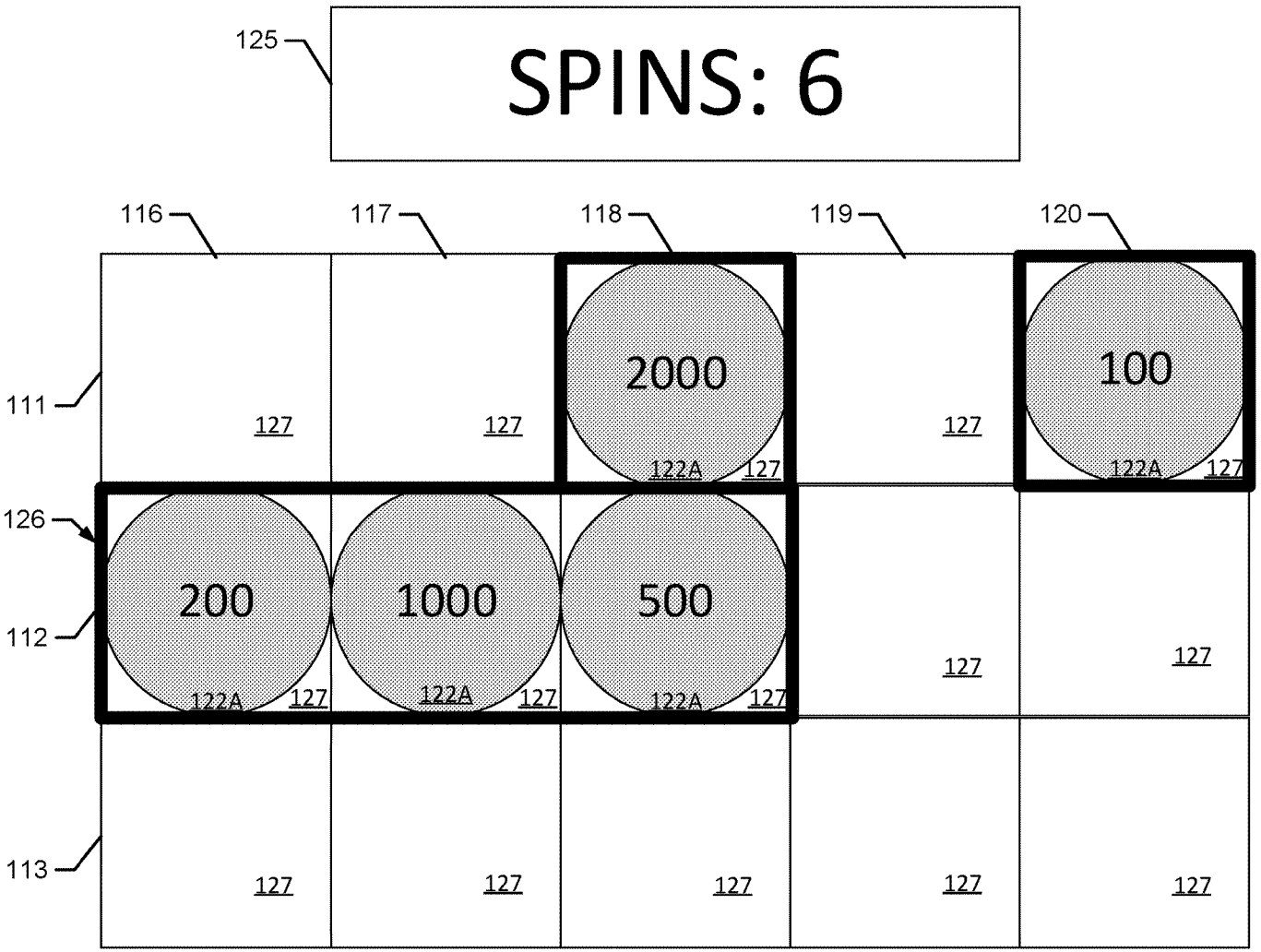
FIG. 20 is an example bonus game showing an additional bonus symbol in an embodiment of the present invention.

Continuing with the depicted example, the cumulative number of additional spins from the first set of bonus symbols is seven spins, as depicted in the spin counter of FIG. 19. For each subsequent spin, the spin counter 125 may decrement the number of spins remaining, at operation 233. As depicted in FIG. 20, the spin counter 125 has been decremented by one to indicate six spins remaining. When the point tabulation is completed for the last spin, with a zero spin count, and no additional spins are awarded, the bonus game ends and the processor may return to the base game.

In an some example embodiments, the processor may generate a dynamic border 126 for the locked bonus symbols 122. The dynamic border 126 may surround each bonus symbol individually, as it is locked in the respective matrix position 127, may surround groups of bonus symbols 122 that are located in abutting matrix positions 127, or any other suitable bordering method. The dynamic border 126 may be rendered as a color border, an object border, such as chain, fire, or the like, or any other suitable border design. In some embodiments, the dynamic border 126 may be animated, such as waves through the chain, burning of the fire, brightening and dimming of the border color, or the like. The dynamic boarder 126 may add desirable exciting visual effects, which may be exciting to the player.

The processor may receive a spin request from the input device to initiate a spin in the bonus game at operation or may initiate a subsequent spin without further input from the player. In either case, the processor may cause a plurality of reels to virtually spin at operation 232. The reels may spin, as discussed above, and stop randomly, stop in a predetermined position, or may be stopped manually by the participant, thus ending the virtual spin upon cessation of the spinning of the plurality of reels.

In response to a cessation of spinning of the plurality of reels in the bonus game, the processor may display zero, one, or more than one additional bonus symbols 122. The processor may determine if one or more additional bonus symbols 122 are displayed in one or more previously unoccupied matrix positions 127, e.g. a matrix position which did not include a locked bonus symbol during the previous spin, at operation 334. The processor may lock an indication of additional bonus symbols in the one or more respective matrix positions 127 in the reel display matrix 109 at operation 235. As depicted in FIG. 20, a new bonus symbol 122 occupies the first row 111 at the third column 118. The processor may cause the bonus symbol 122 to lock in this matrix position 127 during subsequent play, e.g. spins, of the bonus game. As discussed above, the additional bonus symbol 122 may alternatively cascade or move to a different symbol position and remain locked in such position.

In an embodiment, the locked symbols may remain as the originally displayed subtype during subsequent bonus rounds, but the additional bonus symbols may be displayed as any subtype available in the bonus game. For example, the original bonus trigger may have been three bronze coins, which were locked in position. However, the additional bonus symbols 122 may comprise bronze, silver, gold, and/or platinum coins, in an embodiment.

In some example embodiments, the dynamic border 126 may extend to surround the new bonus symbol 122 in response to locking of the bonus symbol 122. Additionally, extending the dynamic border 126 to include the new bonus symbol 122 may indicate to the player that the new bonus symbol 122 is locked.

Turing to the awards associated with the new bonus symbol 122, the processor may display or add any awards associated with one or both sides of the bonus symbol 122 to the player's total values at operation 236 and operation 237, in a manner similar to operations 229 and 230 discussed above. For example, the processor may add the point or payout value on the first side 122A of the bonus symbol 122 to a total payout or total point value for the player and the additional spins on the second side 122B of the bonus symbol 122 to the remaining spins indicated in the spin counter 125. In some instances, the processor may add only the awards of the new bonus symbols 122 to the total payout or total point value and/or the remaining spin value. In other embodiments, some, such as abutting previously displayed bonus symbols 122, or all of the bonus symbols values may be added to the total payout or total point value and/or the remaining spin value. For example, in the first spin, depicted in FIG. 18 the point award of the spin, may be 1800 points, e.g. the sum of 200, 1000, 500, and 100 values of the first sides 122A of the bonus symbols 122. In the second spin, depicted in FIG. 20, the point award of the spin may be 3800 points, e.g. the sum of 200, 1000, 500, and 100 values of the first sides 122A of the bonus symbols 122 of the first spin and the 2000 value of the first side 122A of the new bonus symbol. In this embodiment, the total point value may be 5600 points, e.g. the summation of the 1800 point of the first spin and the 3800 points of the second game. Similarly, if the additional bonus symbols 122 are displayed in symbol positions which comprise certain paylines or scatter pay locations, the player may be awarded accordingly.

In some embodiments, in response to the new bonus symbol 122 of subsequent spins, the processor may cause the point values or payout values to increment by a predetermined amount. For example, the processor may cause the award values to increment to the next largest award value, e.g. 100 to 200, 200 to 500, 500 to 1000, or the like, or increment be a set amount, such as 250. Incrementing the award values may generate added excitement in the bonus game caused by the exponential nature of the bonus increments.

Figure 21:
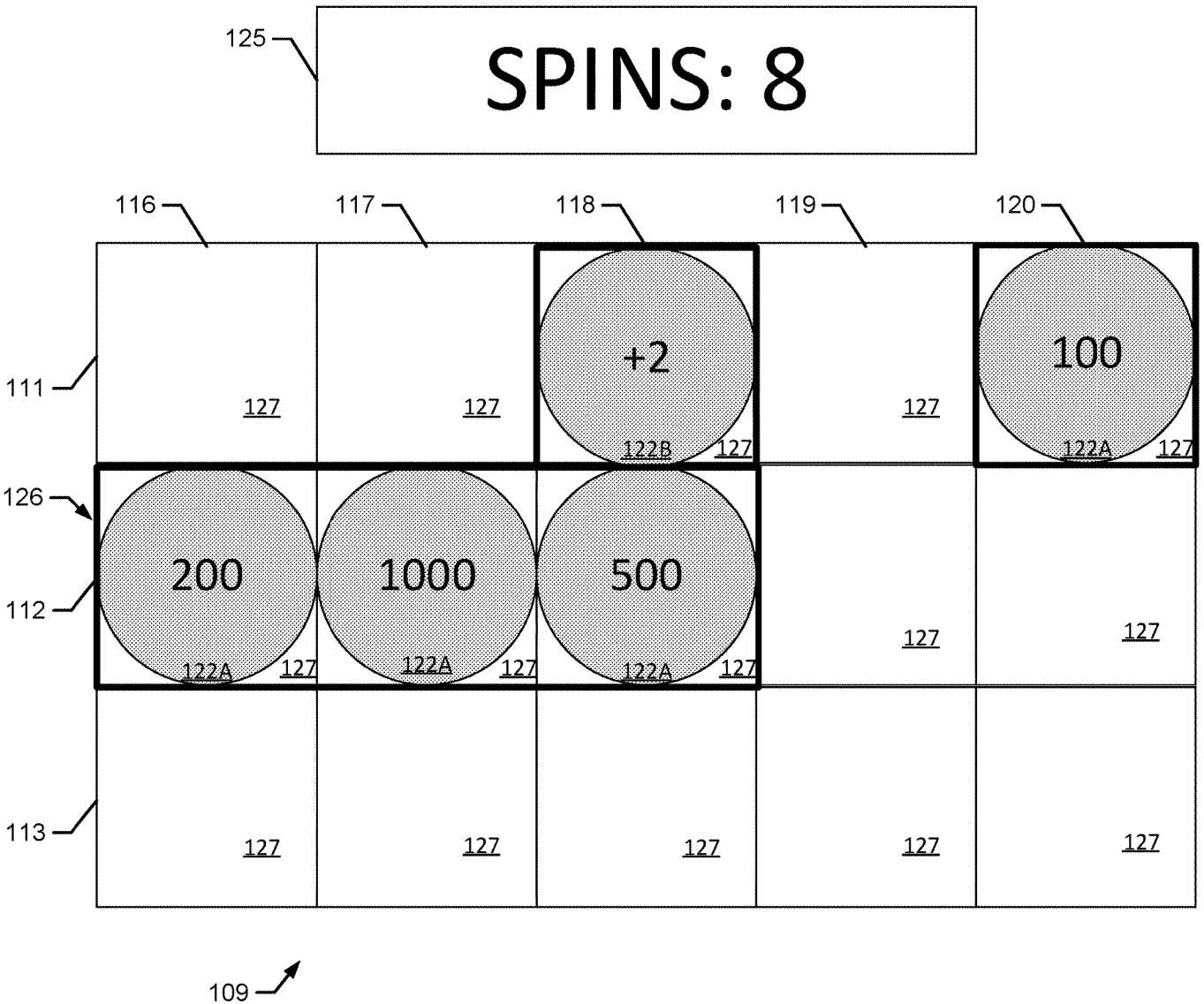
FIG. 21 is an example bonus game showing the second side of the additional bonus symbol in an embodiment of the present invention.
Figure 22:
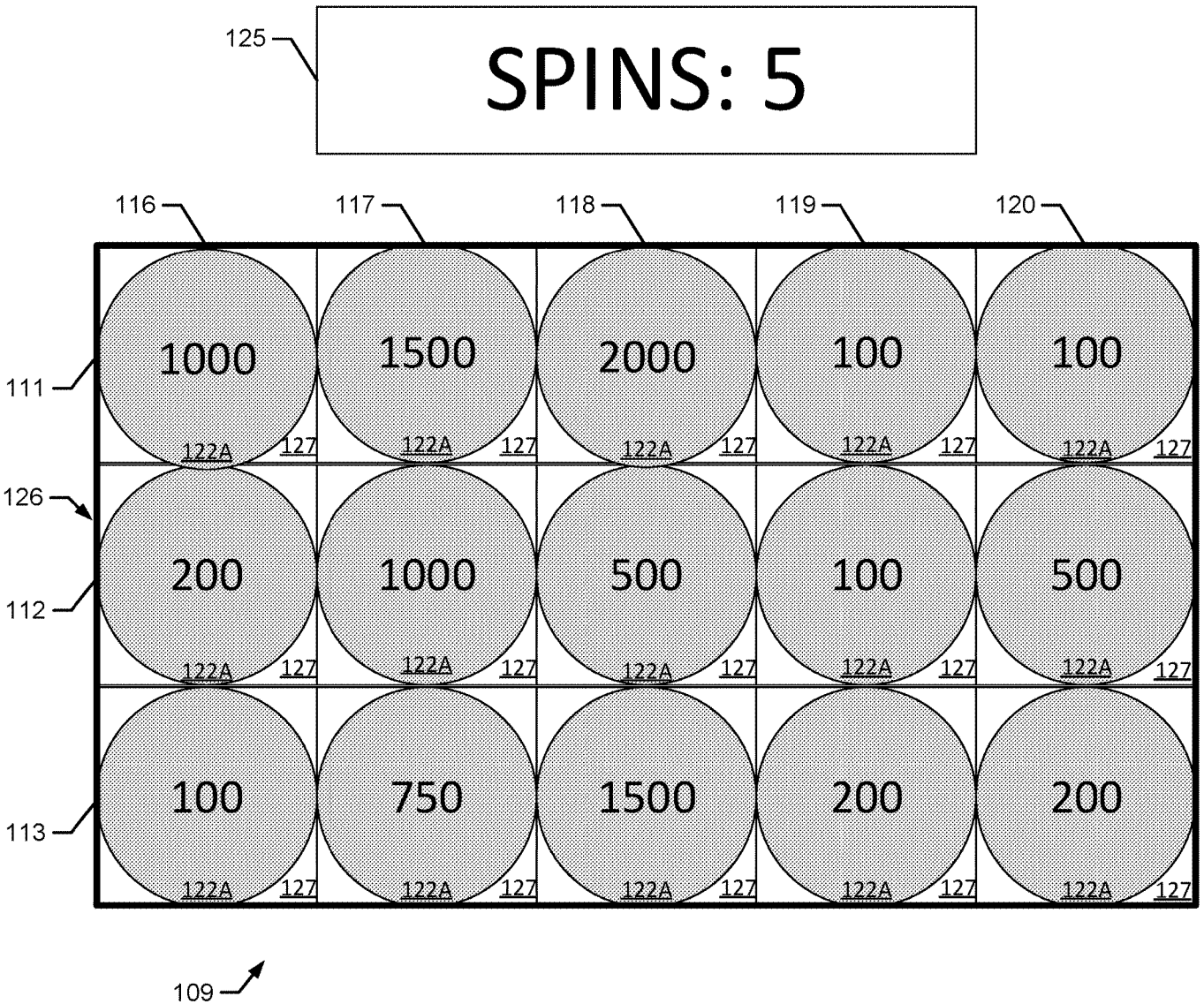
FIG. 22 is an example bonus game with all symbol positions filled in an embodiment of the present invention.

As depicted in FIG. 21, the processor may display the second side 122B of the additional bonus symbol 122 and add the award value, e.g. additional spins to the remaining spins. In the depicted example, the second side 122B of the bonus symbol indicates two additional spins, which have been added to the remaining spins in the spin counter 125 for a total of eight remaining spins. In an embodiment, only the additional bonus symbol awards additional spins. In other embodiments, as noted above, the position of the additional bonus symbol within the reel display matrix 109 may provide the player with additional spins based upon its combination with other bonus symbols 122 or its matrix position 127.

In an embodiment, after the additional spins are displayed and/or awarded, the bonus symbols 122 may flip back to their previous display before the next reel spin begins. In an embodiment, this flip may display point values or some other graphic display.

In some embodiments, the bonus game may continue as discussed above and the processor may lock additional bonus symbols 122 into respective matrix positions 127 in the reel display matrix 109 during each reel spin, until the spins decrement to zero. The processor may determine whether any spins remain at operation 236. Some reel spins may not display additional bonus symbols, award points, or award additional spins. In this case, the bonus game will continue as long as spins are available. In response to the processor determining that no additional spins remain, the processor cause the game system to return to the base game at operation 237.

Figure 26:
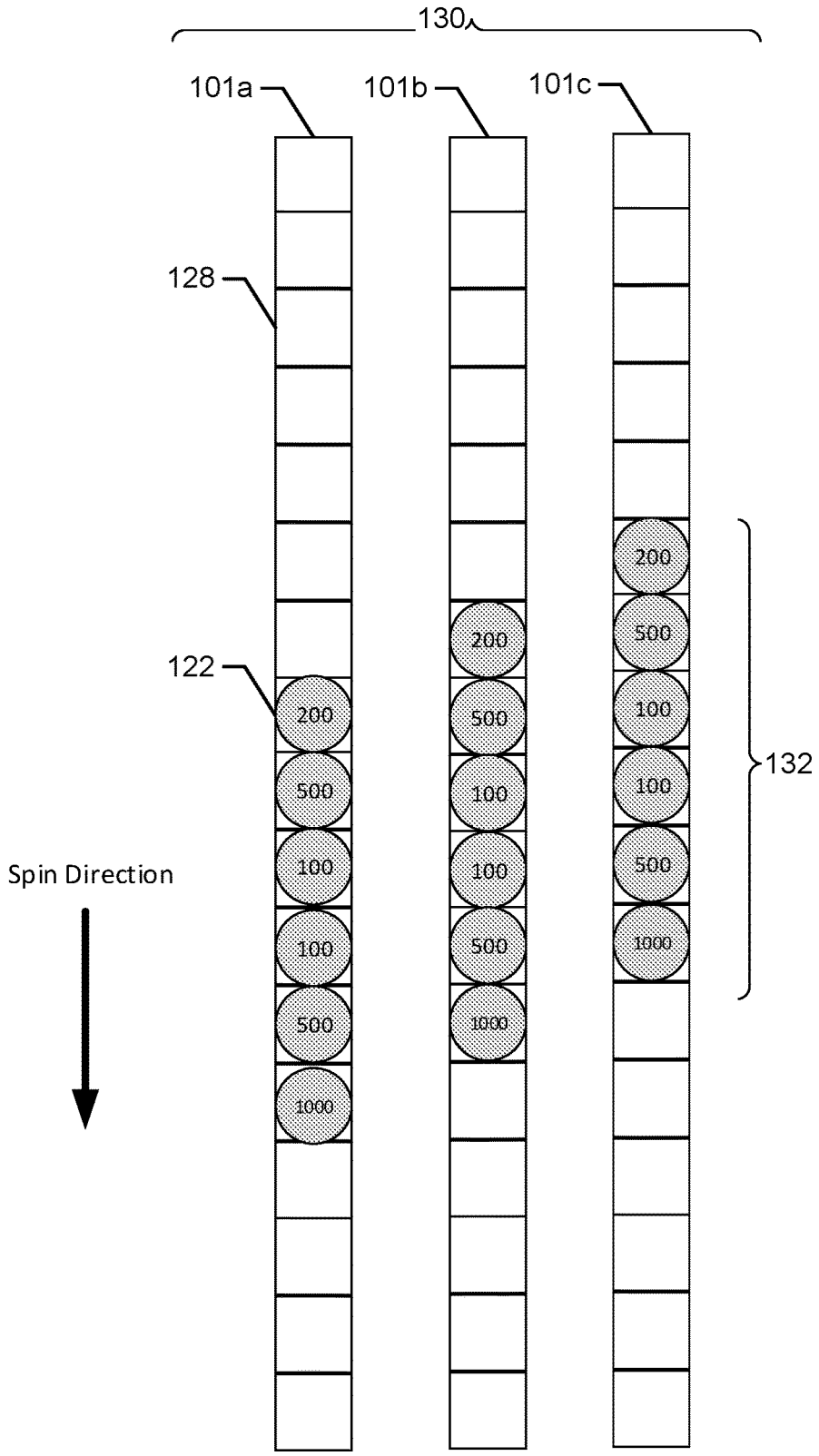
FIG. 26 is a schematic representation of a reel strip layout for simulated stacking in an embodiment of the present invention.

In an embodiment, the processor may be further configured to determine if or when each matrix position 127 of the reel display matrix 109 is occupied by a locked bonus symbol 122, at operation 238. As depicted in FIG. 26, each matrix position is occupied by a bonus symbol 122. In some embodiments, filling each symbol position may trigger the end of the bonus game or a predetermined award, such as a jackpot. In other example embodiments, the processor may be configured to continue the bonus game. For example, the processor may be configured to clear each of the matrix positions 127 in the reel display matrix 109 at operation 239. Additional spins of the reels may cause one or more bonus symbols 122 to stop in the cleared matrix positions 124, such as depicted in FIG. 23.

The bonus game may continue as discussed above until the remaining spins reaches zero and no further additional spins are awarded. At the conclusion of the bonus game a total point value, if utilized, may be converted to a total payout value, and the total payout value added to a payout value or credit value in the base game. Additionally, the display may return to the base game reactivating or displaying the first symbols 121.

While the bonus game is described herein in connection with a stacked symbols base game, it should be understood that the bonus game described could be used with any base game known in the art. The bonus game could be used with a base game of chance or skill.

Additional Reel Strip Layouts

In some example embodiments, additional or alternative reel layouts or schemes may be utilized to add further excitement to the base game or bonus game. The examples below are described in the context of the bonus game for illustrative purposes, but are equally applicable to the base game or any combination thereof.

In the stacked game described above, each of the 5 reel strips 101, 102, 103, 104, and 105 spin on virtual reels in respective columns 116, 117, 118, 119, and 120 through each row 111, 112, and 113 of the reel display matrix 109. In another described embodiment, each of the matrix positions 127 may be associated with a separate virtual reel and reel strip, such that symbols will not appear "stacked" from a user's view point. As rendered in the in the reel display matrix, consecutive identical symbols may be displayed in one of the matrix positions, but would not appear to move from one the top row 11, through the middle row 112, to the bottom row 113, as may be rendered in a traditional reel game.

In an example embodiment, stacking may be simulated in the reel display matrix 109 utilizing separate virtual reels and reel strips in each matrix position 127. As illustrates in FIG. 26, the matrix positions 127 associated with a column, such as the first column 116 may utilize a reel strip group 130. The reel strip group 130 may include a reel strip configured for each of the matrix position of the column 116. In the depicted example, reel strip 101*a* is associated with the top matrix position in row 111, reel strip 101*b* is associated with the middle matrix position in row 112, and reel strip 101*c* is associated with the bottom matrix position in row 113. Each reel strip 101*a*, 101*b*, and 101*c* may include at least one group 132 of consecutive bonus symbols 122. The groups 132 of consecutive bonus symbols 122 may include the same number of bonus symbols and the reel strips 101*a*, 101*b*, and 101*c* may include the same number of symbol positions. Additionally, the groups 132 of consecutive bonus symbols 122 may be offset between the reel strips, such as by one symbol position, two symbol positions, or the like, and during a spin, the reel strips 101*a*, 101*b*, and 101*c* may spin on the virtual reels at approximately the same speed.

As rendered, a first bonus symbol 122 of the group 132 of consecutive bonus symbols 122 associated with reel strip 101*a* may enter the top matrix position 127 of the column 116. As the spin continues, the first bonus symbol 122 associated with reel strip 101*a* may exit the bottom of the top matrix position 127 and the first bonus symbol 122 of the group 132 of consecutive bonus symbols associated with reel strip 101*b* may enter the middle matrix position 127. Similarly, as the first bonus symbol 122 associated with reel strip 101*b* exits the bottom of the middle matrix position 127, the first bonus symbol 122 of the group 132 of consecutive bonus symbols associated with reel strip 101*c* may enter the bottom matrix position. The other bonus symbols of the group 132 of consecutive bonus symbols 122 may follow the first bonus symbols as the virtual reels spins. The offset of the group 132 of consecutive bonus symbols 122 spinning on synchronized virtual reels may simulate the consecutive bonus symbols 122 passing through each matrix position 127 of the column 116, similar to a single virtual reel spinning in the column 116, which may add further excitement to the game.

Figure 27A:
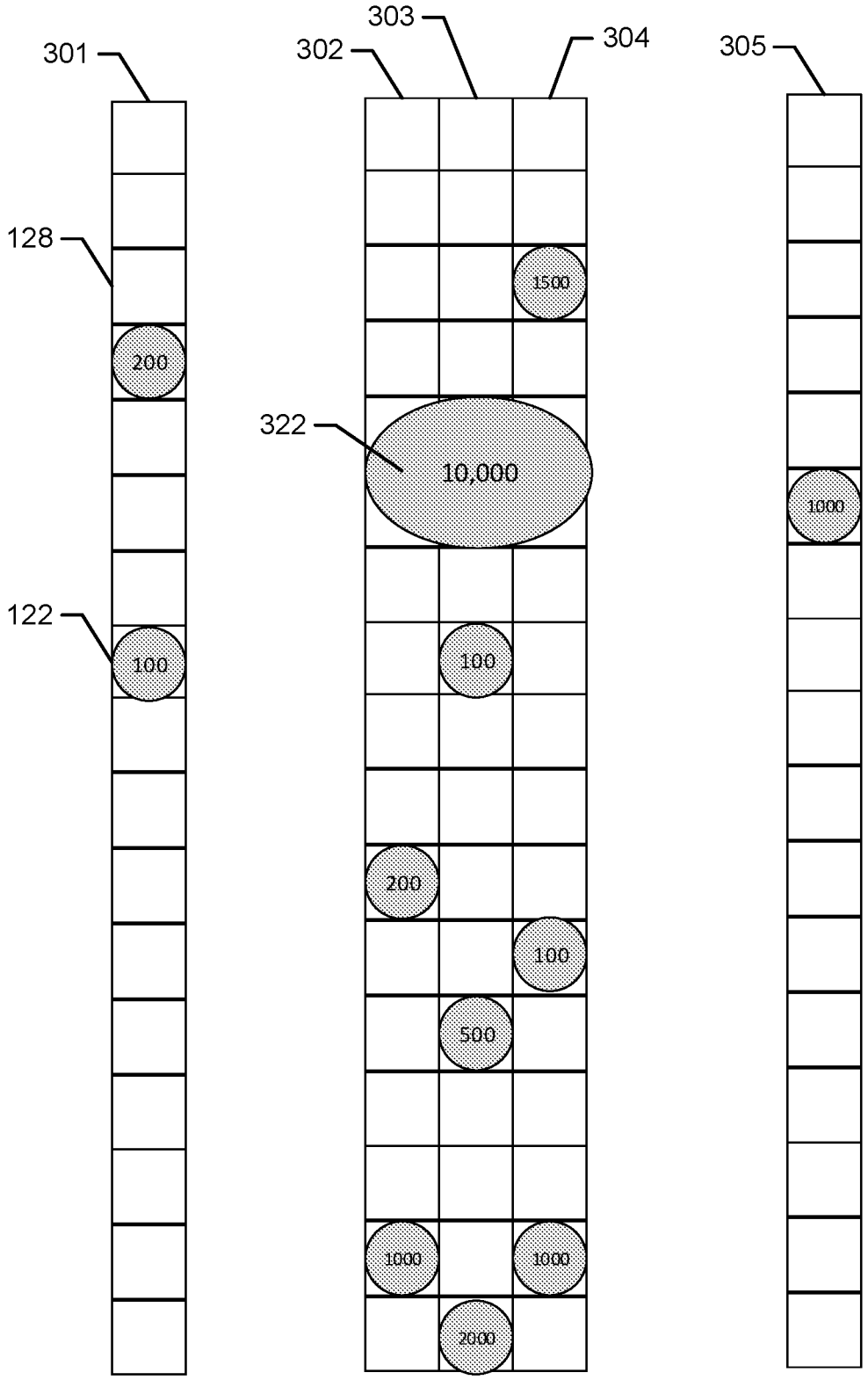
FIGS. 27A-27C are schematic representations of reel strip layouts for large bonus symbols in an example embodiment of the present invention.
Figure 27B:
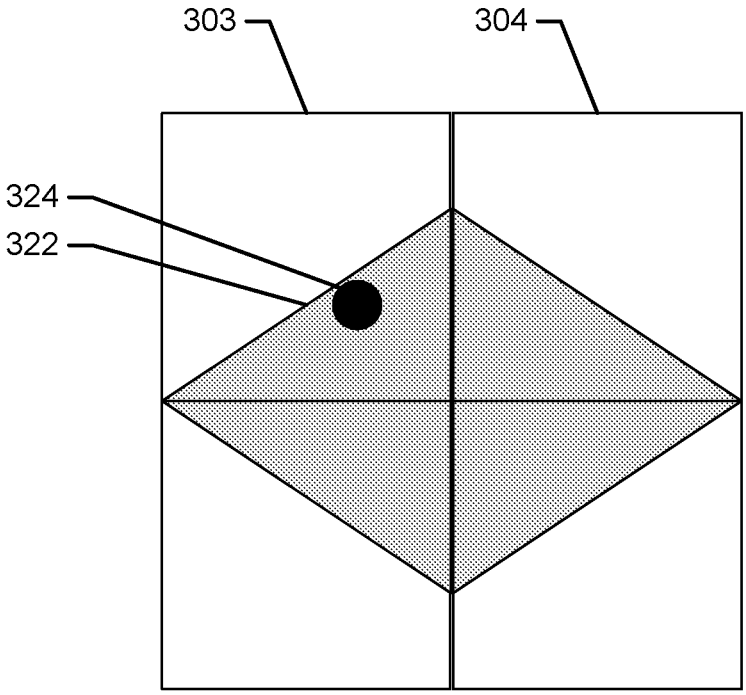

Turning to FIGS. 27A and 27B, one or more reel strips may include large bonus symbols 322, which may cover multiple matrix positions 127. The large bonus symbols 322 may be used to initiate a bonus game during the base game, may be associated with a large point or payout value, may be associated with large number of additional spins, may count in multiple win lines, or the like. The large bonus symbols 322 and/or the potential win values associated with the large bonus symbols 322 may add excitement to spins and extend playablity.

Figure 27C:
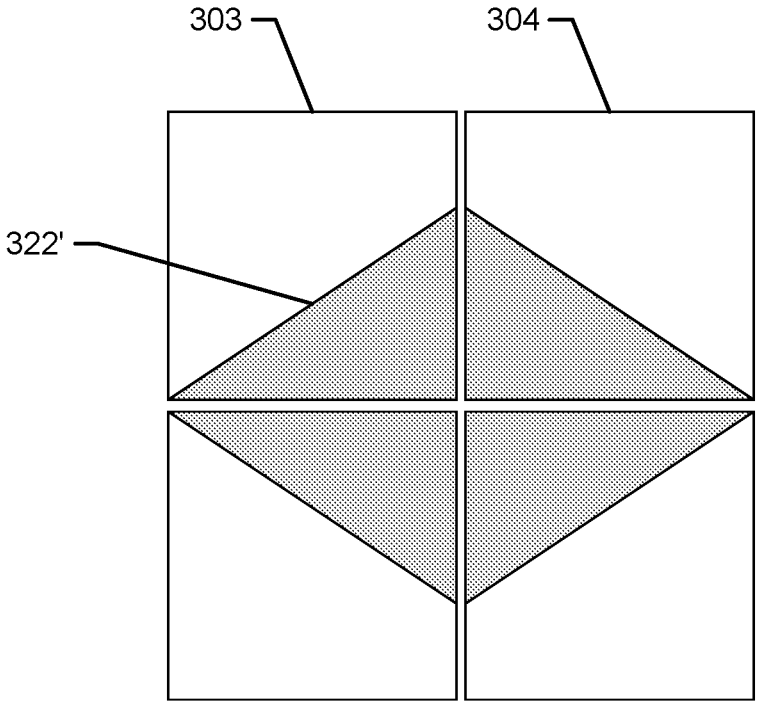

In some example embodiments, the large bonus symbol 322 may cover 2×2 matrix positions, 2×3 matrix positions, 3×3 matrix positions, 4×4 matrix positions, or the like. The large bonus symbols 322 may be one unitary symbol, such as depicted in FIGS. 27A and 27B, or may be segmented portions 322', as depicted in FIG. 27C. The game may payout the award associated with the large bonus symbol 322, in an instance in which a complete large bonus symbol 322 is rendered in the reel display matrix 109 at the cessation of spinning of the virtual reels.

In one example embodiment depicted in FIG. 27A, the large bonus symbol 322 may be associated with multiple symbol position of a plurality of reel strips 301, 302, 303, 304, and 305. In the depicted example, the large bonus symbol is 3×2 symbol positions and associated with two consecutive symbol positions of reel strips 302, 303, and 304. In this embodiment, virtual reels associated with reel strips 302, 303, and 304 may spin together, linked by the large bonus symbol 322. A virtual reels associated with reels trips 301 and 305 may spin independently from virtual reels associated with the large bonus symbol 322.

FIGS. 27B and 27C illustrate portions of reel strips 303 and 304. In the embodiment depicted in FIG. 27B, the large bonus symbol 322 is 2×2 symbol positions and includes an anchor point 324. The anchor point 324 may anchor the large bonus symbol 322 to the symbol position including the anchor point 324. As such, the large bonus symbol 322 may occupy two symbol positions of reel strip 303. With regard to reel strip 304, the reel strip 303 may be independent of reel strip 304 and include the first set of symbols of the game, blanks, 128, and/or bonus symbols 122 in each symbol position, as described above with regard to the base game and/or the bonus game. During a spin, the portion of the large bonus symbol 322 extending into the space of reels strip 304 may be superimposed over the symbol positions of reel strip 304. This embodiment, may enable virtual reels associated with each of the reel strips 301, 302, 303, 304, and 305 to spin independently and include at least one large bonus symbol 322, which extends into multiple reel strip symbol positions.

In the embodiment depicted in FIG. 27C, the large bonus symbol 322 includes segments 322' associated with individual symbol positions of reel strips 303 and 304. In this embodiment, the virtual reels associated with the reel strips 301, 302, 303, 304, and 305, may spin as described above with regards, to the base game and bonus game. The award associated with the large bonus symbol 322 may be awarded in response to the complete, and in some cases properly aligned or assembled, large bonus symbol 322 being rendered in the reel display matrix 109 at the cessation of spinning of the virtual reels.

Description of reel strip layouts, including without limitation, symbol positions of various base game symbols, blanks, bonus symbols, and large bonus symbols in either the base game or bonus game are merely for illustrative purposes. It would be immediate appreciated by one of ordinary skill in the art that any of the reel strip layouts may be used in the base game, the bonus game, or any combination thereof.

Example Architecture

As will be appreciated by one skilled in the relevant field, the present invention may be, for example, embodied as a computer or gaming system, a method, or a computer or gaming program product. Furthermore, particular embodiments may take the form of a computer or gaming program product stored on a computer-readable storage medium having computer-readable instructions (e.g., software) embodied in the storage medium. Various embodiments include web-implemented computer software. Examples of suitable computer-readable storage medium may include, for example, hard disks, compact disks, DVDs, optical storage devices, and/or magnetic storage devices.

The computer program instructions may be loaded onto and execute on a gaming device, a gaming server, a gaming machine, a general purpose computer, a special purpose computer, smart mobile device, or other programmable data processing apparatus to produce a machine. The computer program instructions may be stored in a computer-readable memory that can direct a computer or other programmable data processing apparatus to function in a particular manner such that the instructions stored in the computer-readable memory produce an article of manufacture that is configured for implementing the functions described herein. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified herein.

Figure 7:
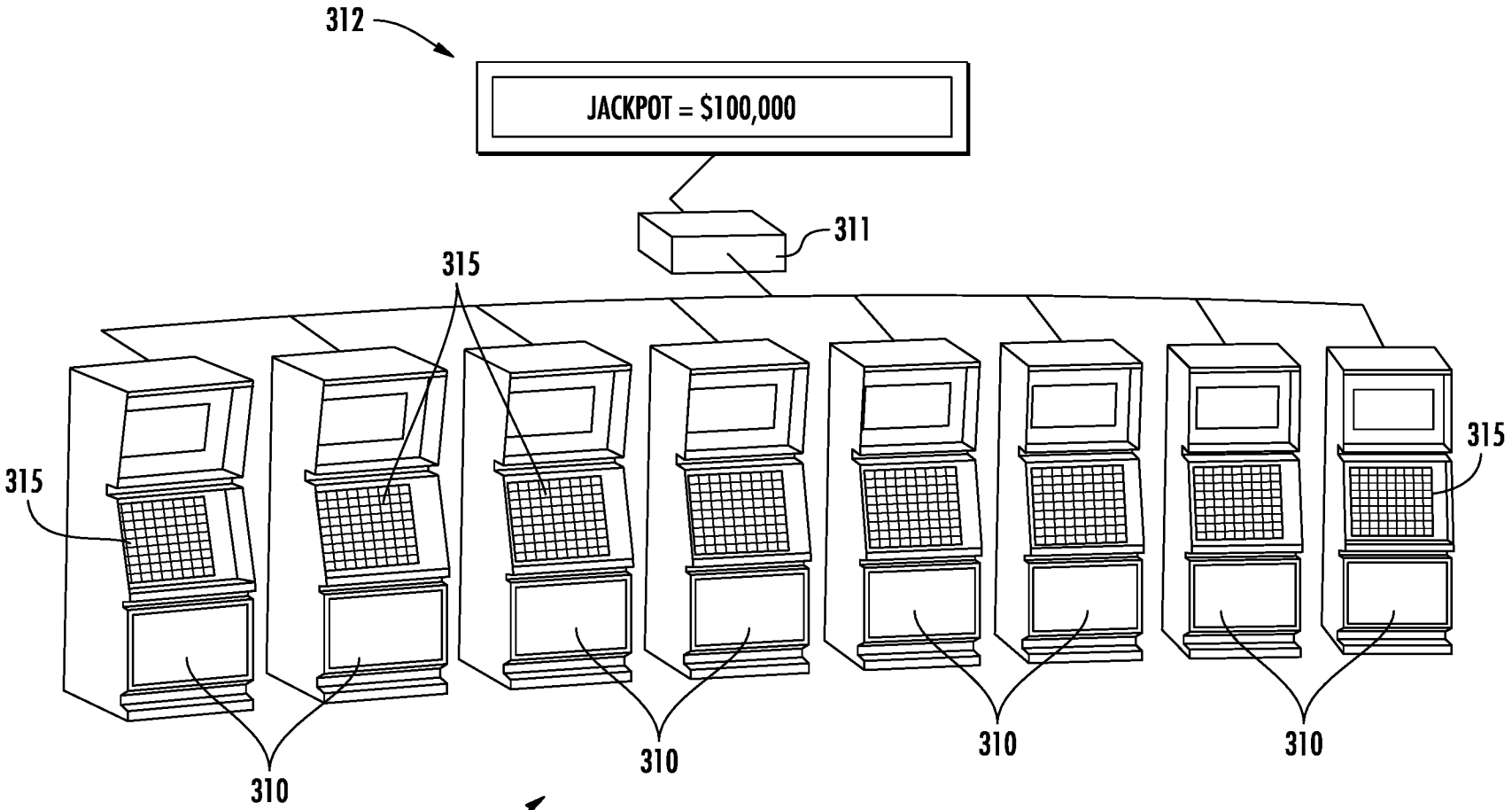
FIG. 7 shows a perspective view of a number of linked gaming machines in an embodiment of the invention.

The inventive system, as shown in FIG. 7, may be a linked system 300. In this embodiment, a plurality of gaming machines 310 may be arranged side-by-side, near one another, in a particular area, or spread out. In an embodiment, a common jackpot prize display 312 may be viewable from each gaming machine 310. Each gaming machine 310 may have a display unit 315. Each of the gaming machines 310 may be electronically linked to one another and, optionally, a jackpot prize display 312 through a control module 311. A win of the jackpot prize may be triggered by specific outcomes. Players may be made aware of a jackpot award by means of the common display 312. It will be appreciated that the linked machines may form part of Local Area Networks (LAN) or Wide Area Networks (WAN).

Figure 8:
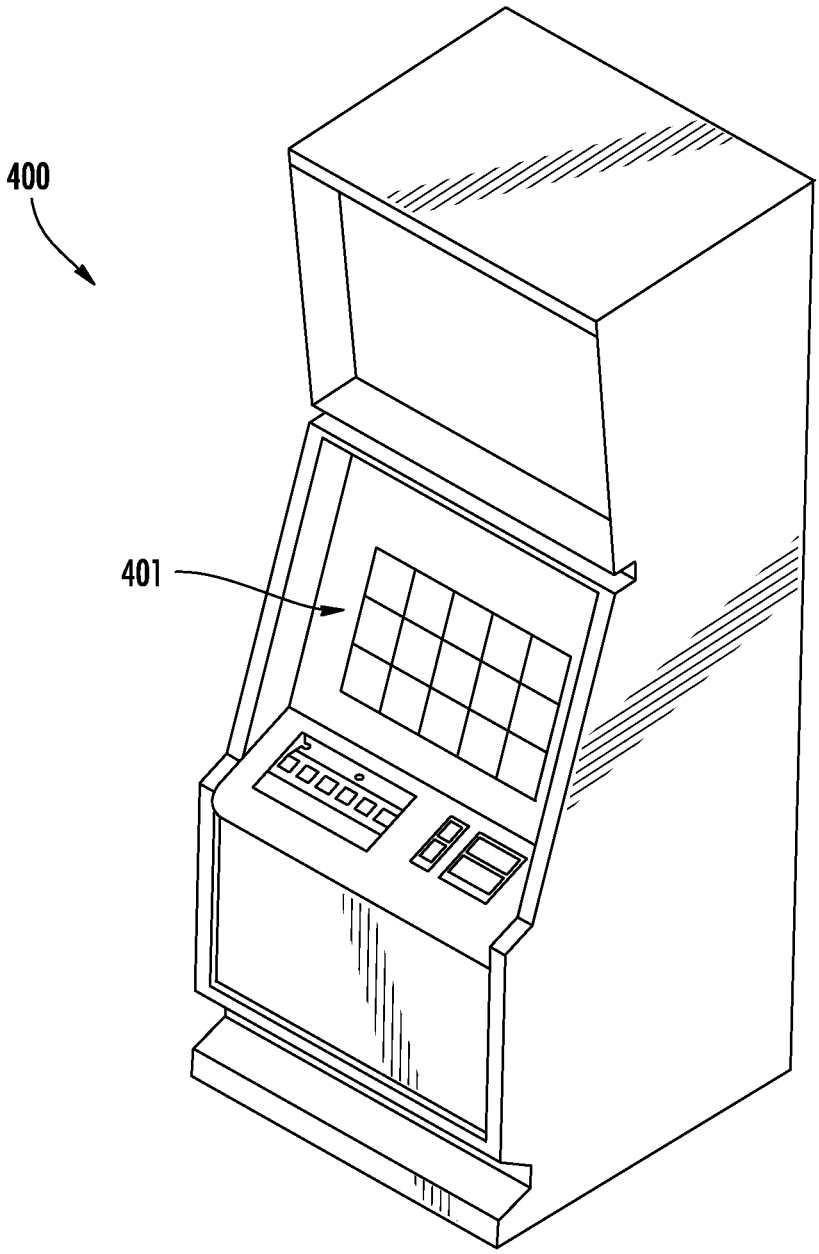
FIG. 8 shows a front view of a stand-alone gaming machine in an embodiment of the invention.

In another embodiment, the inventive system may be operable in a standalone capacity, on a gaming machine 400 (FIG. 8). The gaming machine may have a single display panel 401, double display panel (not shown), or may comprise any other configuration known in the art.

Figure 9:
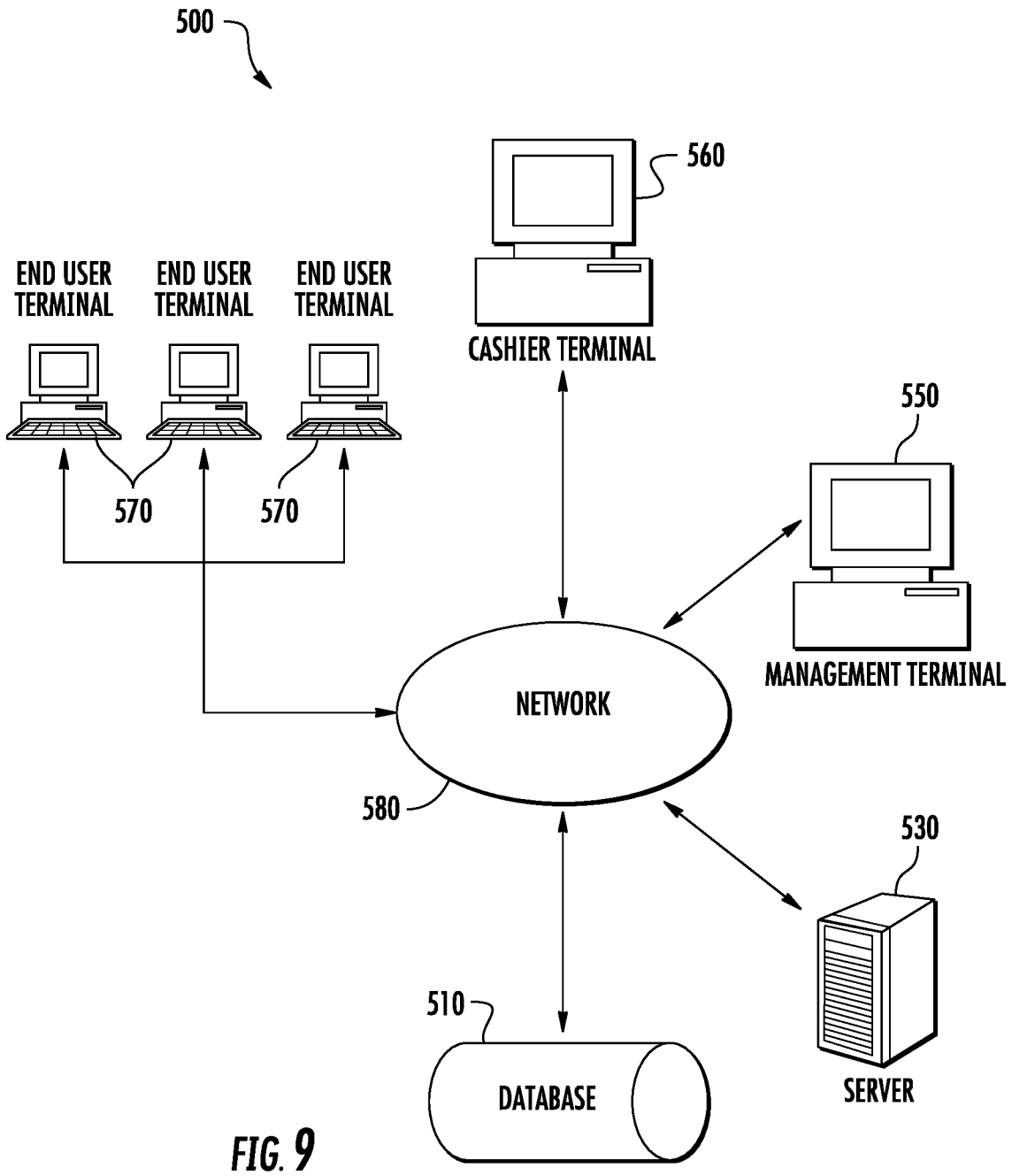
FIG. 9 is a schematic representation of the system in an embodiment of the present invention.

By way of example, and with reference to FIG. 9, in an embodiment, the inventive system 500 may comprise a network 580, a database 510, at least one server 530, optionally, at least one management terminal 550, optionally, at least one cashier terminal (also known as a point-of-sale terminal or POS terminal) 560, and one or more end user terminals 570, or any combination thereof. Those skilled in the art with reference to this disclosure should appreciate that other configurations may be used to accomplish the methods described herein without departing from the scope of the present invention. For example, in various embodiments, the cashier terminal 560 and the end user terminals 570 may comprise the same device.

It should be understood that each of the computing devices, including the server 530, the management terminal 550, the POS terminal 560, and the one or more end user terminals 570 may each have a computer hardware processor, input and output devices (for example, a computer monitor, a keyboard, selection buttons, and/or mouse) and at least one storage device (for example, memory, hard drives, etc.). These devices may also have network connection cards to connect to the network. At least some of these devices may also include a computer readable medium, which is further described herein.

The server 530 may be configured to communicate data to and from various devices in the system and to perform one or more method steps, as detailed below. The database 510 may contain various types of data and computer instructions for performing at least some of the steps presented herein. It should be understood that the network 580 may be comprised of multiple servers 530 and multiple databases 510, whether located locally and networked through a LAN or remotely through a WAN or an Intranet connection. The end user terminals 570 may be linked together via a network. Each end user terminal 570 may be a standalone gaming device, a kiosk, a personal computer (PC), a smart phone, a tablet, or other computing device.

The POS terminal 560 and/or the end user terminals 570 may allow a user to purchase game plays. In some embodiments, a user account card may be issued by the POS terminal 560, which contains an electronic account detailing user account information. The user account card may be used at the end user terminals 570 to participate in the games described herein.

A POS terminal 560 (through a cashier or directly) may provide the user with a receipt containing a code (such as a 16-digit hexadecimal code), a PIN, or a username/password that the user may then use for accessing the system or to access his/her account on an end user terminal 570. In an online embodiment, the user may access the inventive system through a browser interface that may provide a similar code to the user after account creation. This code may provide access to the software and/or specifically to the customer's account on the software.

In various embodiments, the system may allow a user to deposit currency into an end user terminal 570 through a credit card reader, currency/bill acceptor, or other device as is known in the art. The management terminal 550 may be a device that is operatively connected with the POS terminal 560, end user terminals 570, and/or server 530 to run cashier reports, calculate revenues and costs, track purchases of games, track prizes awarded, and/or review other game data. Other managerial or supervisory operations may also be performed using the management terminal 550. The server 530 may control one or more operations of the game system, as discussed herein.

One or more of the devices illustrated in FIG. 9 may be connected to network 580 as previously mentioned. In one embodiment, all devices in FIG. 9 are connected to the network 580 and communicate with each other over the network 580. It should be noted that the network 580 in FIG. 1 need not be a single network (such as only the internet) and may be multiple networks (whether connected to each other or not). In another embodiment, the network may be a LAN and a WAN (e.g., the Internet) such that one or more devices (for example, server 530, management terminal 550 and database 510) are connected together via the LAN, and the LAN is connected to the WAN which in turn is connected to other devices (for example, end user terminals 570). The terms "linked together" or "connected together" refers to devices having a common network connection via a network (either directly on a network or indirectly through multiple networks), such as one or more devices on the same LAN, WAN or some network combination thereof. It should be understood that FIG. 9 is an exemplary embodiment of the present system and various other configurations are within the scope of the present system. For example, one or more of the management terminal 550, point of sale terminal 560, and end user terminals 570 may all be located in one location and server 530 may be located in another location, where all of these system components are operatively coupled by a network such as the Internet. Additionally, it should be understood that additional devices may be included in the system shown in FIG. 9 and some devices shown in FIG. 9 may be omitted from a particular inventive system, such as, by way of example, the point of sale terminal 560. In other embodiments, certain devices may perform the operation of other devices shown in the FIG.

Figure 14:
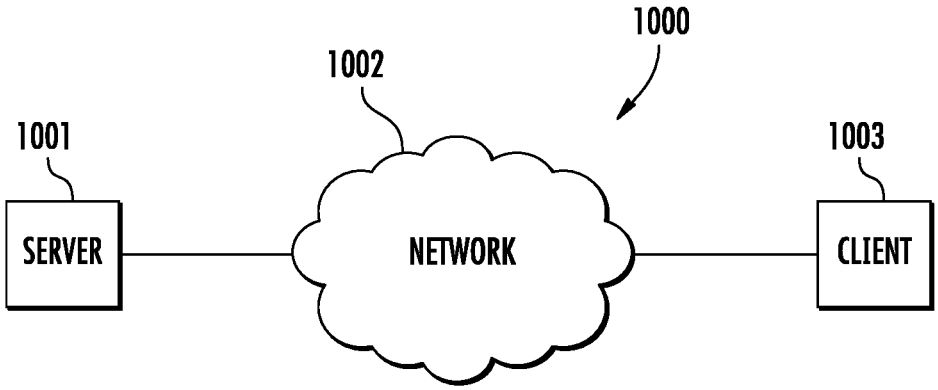
FIG. 14 is a block diagram of the system in an embodiment of the present invention.

In an embodiment, the inventive system may be available to customers online, via the internet. As shown in FIG. 14, in an embodiment, the system 1000 includes a client device 1003 that is connected to a server 1001 via a network 1002. A participant may use the client device 1003 to access the game functionality, which is hosted on the server 1001. In an embodiment, the game functionality is implemented electronically by software that runs on the server 1001. The client device 1003 may comprise any type of computing device, as discussed herein.

For purposes of this disclosure, reference to a server or processor, shall be interpreted to include: a single server, a single processor; multiple servers; multiple processors; or any combination of servers and processors. In particular embodiments of the invention, any of the end user terminal 570, the cashier terminal 560, the management terminal 550, and the server 530 may be a computer. The computer may be connected (e.g., networked) to other computers by a LAN, an intranet, an extranet, and/or the Internet. The computer may operate in the capacity of a server or a client computer in a client-server network environment, or as a peer computer in a peer-to-peer (or distributed) network environment. The computer may be a PC, a tablet, a handheld device, a set-top box (STB), a Personal Digital Assistant (PDA), a web appliance, a server, or any computer capable of executing a set of instructions (sequential or otherwise) that specify actions to be taken by that computer. Further, the term "computer" may also include any collection of computers that individually or jointly execute a set (or multiple sets) of instructions to perform any one or more of the methodologies discussed herein.

In some embodiments, the computer architecture may include a processor, a main memory (e.g., read-only memory (ROM), flash memory, dynamic random access memory (DRAM) such as synchronous DRAM (SDRAM) or Rambus DRAM (RDRAM), etc.), a static memory (e.g., flash memory, static random access memory (SRAM), etc.), and a data storage device, which communicate with each other via a bus.

The processor may be one or more general-purpose processing devices such as a microprocessor, a central processing unit, or the like. More particularly, the processing device may be a complex instruction set computing (CISC) microprocessor, reduced instruction set computing (RISC) microprocessor, very long instruction word (VLIW) microprocessor, a processor implementing other instruction sets, or processors implementing a combination of instruction sets. The processor may also be one or more special-purpose processing devices such as an application specific integrated circuit (ASIC), a field programmable gate array (FPGA), a digital signal processor (DSP), a network processor, or the like. The processor may be configured to execute processing logic for performing various operations and steps discussed herein.

The computer architecture may further include a network interface device. The computer architecture also may include a video display (e.g., a liquid crystal display (LCD) or a cathode ray tube (CRT)), an alphanumeric input device (e.g., a keyboard), a cursor control device (e.g., a mouse), and a signal generation device (e.g., a speaker).

The data storage device may include a machine accessible storage medium (also known as a non-transitory computer-accessible storage medium, a non-transitory computer-readable storage medium, or a non-transitory computer-readable medium) on which is stored one or more sets of instructions embodying any one or more of the methodologies or functions described herein. The system may also reside, completely or at least partially, within the main memory and/or within processing device during execution thereof by a computer. The main memory and processing device also constitute computer-accessible storage media. Instructions may further be transmitted or received over a network via a network interface device.

While the machine-accessible storage medium may be a single medium, the term "machine-accessible storage medium" should be understood to include a single medium or multiple media (e.g., a centralized or distributed database, and/or associated caches and servers) that store the one or more sets of instructions. The term "machine-accessible storage medium" shall also be understood to include any medium that is capable of storing, encoding, or carrying a set of instructions for execution by the computer and that cause the computer to perform any one or more of the methodologies of the present invention. The term "computer-accessible storage medium" shall accordingly be understood to include, but not be limited to, solid-state memories, optical, and magnetic media. The game system that resides on server 530 may provide various functionalities as discussed herein. In various embodiments, the participant may access the inventive games through end user terminal 570.

Figure 12:
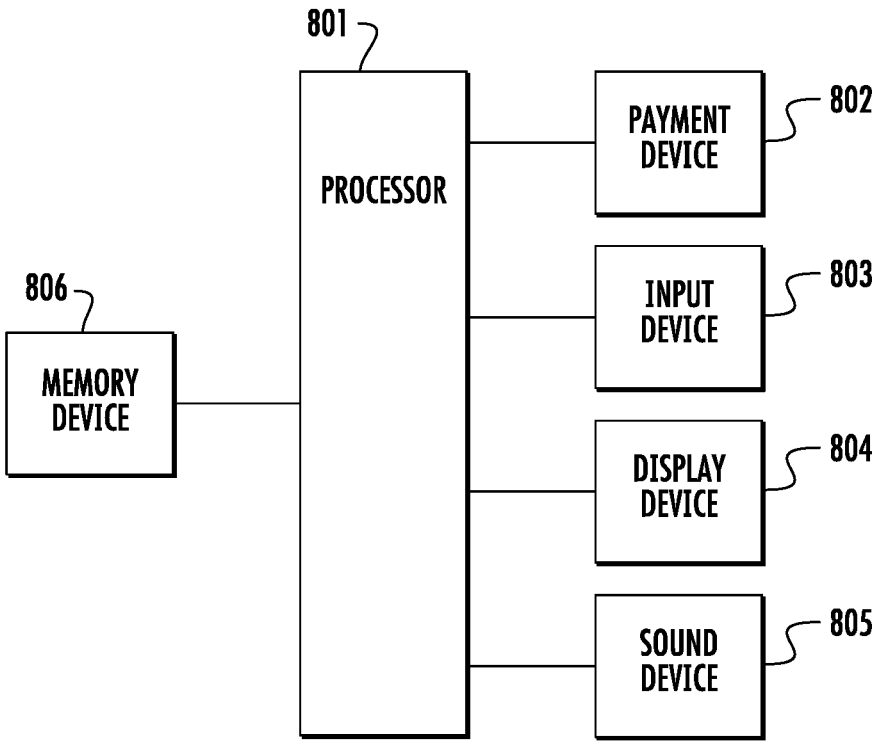
FIG. 12 is a block diagram of the system in an embodiment of the present invention.

In an embodiment, shown in FIG. 12 and as discussed in detail above, the processor 801 may communicate with a payment device 802, one or more input devices 803, one or more display devices 804, a sound device 805, and a memory device 806. The payment device may comprise a note, ticket or bill acceptor, wherein the player inserts paper money, a ticket or voucher. The payment device 802 may comprise a coin slot where the player inserts coins or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, RFID or any other suitable wireless device which communicates a player's identification, credit totals (or related data) and other relevant information to the gaming device.

In one embodiment, one or more gaming devices 570 are in communication with each other and/or at least one central server 530, central controller or remote host through a data network 580 or remote communication link. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

A gaming device as described herein can be configured to enable a player to immediately begin playing the game upon a wager on the game or a payment to play the game. In one embodiment, the player must make a minimum wager before the gaming device enables the game. That is, the processor does not select the inventive reel strips until the player's wager meets a predetermined threshold. Instead, the system may provide the player with a set of standard reels. In an alternative embodiment, the inventive game is configured as a secondary or bonus game. In one such embodiment, if a predetermined triggering event occurs in a primary game, the game device is configured to enable a player to play the inventive game. In one embodiment, the triggering event in the primary game may not occur until the player has made a minimum wager on the primary game.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel strip combination, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first win outcome of $10 which will be provided to a first player regardless of how the first player plays in a first game and a second gaming device to have selected elements marked in a different predetermined pattern is provided a second win outcome of $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In any of the discussed embodiments, a predetermined game outcome value is determined for each of a plurality of linked or networked gaming devices based on the results of a bingo, keno or lottery game and a predetermined set of reel strips will be displayed to the player in association with the predetermined game outcome. In this embodiment, the set of predetermined reel strips (and the reels in general) will not determine the win, but will instead be selected as a result of (or in association with) the win (the predetermined game outcome value). Thus, predetermined game outcome value of a bingo game is $10, the inventive system may select a set of reel strips that will display a visual pattern of symbols that equals a $10 win.

Many modifications and other embodiments of the invention will come to mind to one skilled in the art to which this invention pertains having the benefit of the teachings presented in the foregoing descriptions and the associated drawings. While examples discussed above cover the use of the invention in the context a content management service, the invention may be used in any other suitable context. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for the purposes of limitation.

What is claimed is:

1. A gaming system comprising:

at least one input device;

at least one display device configured to display a game comprising a matrix of rotating reels;

a processor;

and at least one memory including computer program code configured to, with the processor, cause the gaming system to:

receive a spin request from the input device to initiate a first spin in a primary game;

cause, in response to the request, a plurality of reels to virtually spin, wherein each of the plurality of reels comprises a plurality of first symbols and at least one of the reels comprises at least one bonus symbol;

determine, in response to a cessation of spinning of the plurality of reels, a number of bonus symbols displayed within a reel display matrix;

trigger a secondary game in response to the number of bonus symbols satisfying a predetermined bonus symbol threshold, wherein in the secondary game, at least one bonus symbol comprises a first indicia and a second indicia, wherein the first indicia indicates a first award and the second indicia indicates a second award, and wherein the first award is a different award type than the award type of the second award; and initiate, within said secondary game, at least one additional spin, wherein the at least one bonus symbol is locked in a designated symbol position during the additional spin.

2. The gaming system of claim 1, wherein the bonus symbol sequentially displays a first side and a second side, wherein the first award is disposed on the first side and the second award is disposed on the second side.

3. The gaming system of claim 2, wherein the at least one bonus symbol sequentially displays a first side indicating a won point value, a second side indicating a won number of spins, and then the first side again, indicating the won point value, prior to initiating an additional spin.

4. The gaming system of claim 1, wherein the first award is a point value or payout value.

5. The gaming system of claim 1, wherein the second award is a number of additional spins.

6. The gaming system of claim 5, wherein the additional spins are added to a total number of available spins remaining in the secondary game.

7. The gaming system of claim 1, wherein the displayed bonus symbols are selected from a plurality of available bonus symbols.

8. The gaming system of claim 7, wherein each of the available bonus symbols have associated numbers of free spins, multiplier values, and/or jackpot values.

9. The gaming system of claim 7, wherein each of the available bonus symbols have associated ranges of free spins, ranges of multipliers values, and/or ranges of jackpot values.

10. The gaming system of claim 7, wherein the displayed bonus symbols are selected from the available bonus symbols based upon the bet level.

11. The gaming system of claim 1, further comprising determining, in response to a cessation of the at least one additional spin, a number of additional bonus symbols to be displayed within the reel display matrix, displaying such additional bonus symbols, and displaying sequentially the first award and the second award for said additional bonus symbols.

12. The gaming system of claim 11, wherein, if there are available spins remaining in the secondary game, the at least one additional bonus symbol is locked in a designated symbol position and an additional spin is initiated.

13. The gaming system of claim 1, wherein a total number of available spins remaining in the secondary game is decremented for each additional spin initiated in the secondary game.

14. The gaming system of claim 1, wherein the plurality of reels display only bonus symbols or empty symbol positions during the secondary game.

15. The gaming system of claim 1, wherein the designated locked symbol position is the position wherein the bonus symbol was displayed at cessation of spinning.

16. A gaming system comprising:

at least one input device;

at least one display device configured to display a game comprising a matrix of rotating reels;

a processor; and at least one memory including computer program code configured to, with the processor, cause the gaming system to:

receive a spin request from the input device to initiate a spin in a first game;

cause, in response to the request, a plurality of reels to virtually spin, wherein each of the plurality of reels comprises a plurality of first symbols and at least one of the reels comprises at least one bonus symbol;

determine, in response to a cessation of spinning of the plurality of reels, a number of bonus symbols displayed within a reel display matrix; and trigger a second game in response to the number of bonus symbols satisfying a predetermined bonus symbol threshold;

wherein in the secondary game, at least one bonus symbol comprises a first indicia and a second indicia, wherein the first indicia indicates a first award and the second indicia indicates a second award, and wherein the first award is a different award type than an award type of the second award;

lock an indication of the bonus symbols from the first game at respective positions in the reel display matrix in the second game;

sequentially display the first award and the second award, each associated with a bonus symbol;

initiate an additional spin in the second game, wherein each of the plurality of reels comprises at least one additional bonus symbol;

decrement an available number of remaining spins in the second game;

lock an indication of an additional bonus symbol, in response to a cessation of the additional spin of the plurality of reels in the second game, at a respective position in the reel display matrix;

sequentially display the first award and the second award, each associated with an additional bonus symbol; and repeat the initiate, decrement, lock, and sequentially display steps until no remaining spins are available in the second game.

17. The gaming system of claim 16, wherein each matrix position of the reel display matrix is associated with a separate reel strip.

18. The gaming system of claim 16, wherein the at least one bonus symbol and additional bonus symbol comprise a first side and a second side, wherein the first award is a point value that is disposed on the first side and the second award is a number of spins awarded that is disposed on the second side.

19. The gaming system of claim 18, wherein the sequential display comprises displaying the first side comprising the point value, the second side comprising the number of awarded spins, and the first side, again, comprising the point value.

20. The gaming system of claim 16, wherein the memory and processor are further configured to determine that each matrix position of the reel display matrix is occupied by a locked bonus symbol or additional bonus symbol; clear each matrix position of the reel display matrix; and repeat the initiate, decrement, lock, and sequentially display steps until no remaining spins are available in the second game.

21. The gaming system of claim 16, further comprising the step prior to initiating the additional spin, the bonus symbol sequentially displays a first side indicating a won point value and a second side indicating a won number of spins, wherein the first award is disposed on the first side and the second award is disposed on the second side, and then displaying the first side again indicating the won point value.

22. The gaming system of claim 16, wherein the first award comprises a point value and the second award comprises a number of spins awarded.

* * * * *